US009365962B2

(12) United States Patent
Lonati et al.

(10) Patent No.: US 9,365,962 B2
(45) Date of Patent: Jun. 14, 2016

(54) METHOD FOR PREPARING A TUBULAR MANUFACTURE SUCH AS A HOSIERY ITEM OR THE LIKE FOR AUTOMATED PICK-UP AT THE END OF ITS FORMATION ON A DOUBLE-CYLINDER CIRCULAR MACHINE WITH AT LEAST ONE FEED OR DROP AND DOUBLE-CYLINDER CIRCULAR MACHINE FOR PERFORMING THE METHOD

(75) Inventors: Ettore Lonati, Botticino (IT); Fausto Lonati, Brescia (IT); Tiberio Lonati, Brescia (IT)

(73) Assignee: LONATI S.P.A., Brescia (IT)

( * ) Notice: Subject to any disclaimer, the term of this patent is extended or adjusted under 35 U.S.C. 154(b) by 0 days.

(21) Appl. No.: 14/344,503

(22) PCT Filed: Jul. 23, 2012

(86) PCT No.: PCT/EP2012/064416

§ 371 (c)(1),
(2), (4) Date: May 29, 2014

(87) PCT Pub. No.: WO2013/041268

PCT Pub. Date: Mar. 28, 2013

(65) Prior Publication Data

US 2015/0000348 A1 Jan. 1, 2015

(30) Foreign Application Priority Data

Sep. 19, 2011 (IT) ..... MI2011A1683

(51) Int. Cl.
*D04B 9/40* (2006.01)
*D04B 9/46* (2006.01)
(Continued)

(52) U.S. Cl.
CPC . *D04B 9/46* (2013.01); *A41B 11/00* (2013.01); *D04B 9/10* (2013.01); *D04B 9/40* (2013.01); *D04B 9/56* (2013.01)

(58) Field of Classification Search
CPC ..... D04B 9/40; D04B 15/02; D04B 15/88; D04B 9/46; D04B 9/56
USPC ..... 66/147, 148, 149 R, 150
See application file for complete search history.

(56) References Cited

U.S. PATENT DOCUMENTS 4,233,822 A 11/1980 Lonati
6,282,925 B1 * 9/2001 Ando' ..... 66/17
(Continued)

FOREIGN PATENT DOCUMENTS

CN 1233675 A 3/1999
CN 2476572 Y 2/2002
(Continued)

OTHER PUBLICATIONS

International Search Report and Written Opinion for related PCT Patent App. No. PCT/EP2012/064416 dated Oct. 8, 2012.
(Continued)

*Primary Examiner* — Danny Worrell
(74) *Attorney, Agent, or Firm* — Husch Blackwell, LLP

(57) ABSTRACT

A method for preparing a tubular manufacture such as a hosiery item or the like for automated pick-up at the end of its formation on a double-cylinder circular machine including at least the following steps: —a first step, which consists in transferring or retaining all the needles in the lower needle cylinder; —a second step, which consists in moving all the needles to the tuck-stitch position; —a third step, which consists in pushing upward the portion of the manufacture engaged with the needles; —a fourth step, which consists in disengaging the sinkers from the manufacture; —a fifth step, which consists in lifting the needles into the dropped-stitch position.

10 Claims, 18 Drawing Sheets

(51) Int. Cl.

| | |
|---|---|
| ***D04B 9/10*** | (2006.01) |
| ***A41B 11/00*** | (2006.01) |
| ***D04B 9/56*** | (2006.01) |

(56) References Cited

U.S. PATENT DOCUMENTS

| | | | | |
|---|---|---|---|---|
| 6,698,250 | B2 * | 3/2004 | Lonati et al. | 66/149 S |
| 7,975,513 | B2 * | 7/2011 | Lonati et al. | 66/148 |
| 2001/0052248 | A1 | 12/2001 | Ando | |

FOREIGN PATENT DOCUMENTS

| | | | |
|---|---|---|---|
| CN | 201411539 | Y | 2/2010 |
| CN | 201809578 | U | 4/2011 |
| EP | 0074931 | A1 | 3/1983 |
| EP | 0780502 | A2 | 6/1997 |
| EP | 0 942 086 | A2 | 9/1999 |
| GB | 264 634 | A | 1/1927 |
| JP | A 2011 514940 | | 5/2011 |

OTHER PUBLICATIONS

Search Report and Written Opinion for related Italian Patent App. No. IT M120111683 dated Jul. 27, 2012.

Examintion report for related Chinese application No. CN2012856849, dated Feb. 12, 2015 (5 pgs.).

Japanese Office Action and English translation in related application dated Feb. 2, 2016 (9 pgs.).

* cited by examiner

METHOD FOR PREPARING A TUBULAR MANUFACTURE SUCH AS A HOSIERY ITEM OR THE LIKE FOR AUTOMATED PICK-UP AT THE END OF ITS FORMATION ON A DOUBLE-CYLINDER CIRCULAR MACHINE WITH AT LEAST ONE FEED OR DROP AND DOUBLE-CYLINDER CIRCULAR MACHINE FOR PERFORMING THE METHOD

The present invention relates to a method for preparing a tubular manufacture such as a hosiery item or the like for automated pick-up at the end of its formation on a double-cylinder circular machine with at least one feed or drop and to a double-cylinder circular machine for performing the method.

WO2009/112346 in the name of the same Applicant discloses an apparatus and a method for performing the closing of a tubular knitted manufacture at one of its axial ends at the end of its manufacturing cycle on a circular hosiery machine or the like.

The method consists substantially in removing the manufacture, at the end of its production, from the needles of the machine by means of a pick-up device and in transferring the manufacture in a region arranged laterally to the needle cylinder of the machine where there is a handling device, which receives the manufacture from the pick-up device and arranges mutually side by side the two flaps of the axial end of the manufacture to be closed, and a sewing head, which joins the two flaps, thus closing the axial end of the manufacture.

The pick-up device that is disclosed in said International patent application and is the subject of WO2009/112347 comprises an annular body which can be arranged coaxially around the upper end of the needle cylinder of a single-cylinder circular hosiery knitting machine and supports, within radial slots, pick-up elements which can move on command radially and can each engage, by means of their end directed toward the axis of the annular body, the stem of a needle of the machine, below the tab, so as to receive in such end, which is shaped like a hook with the tip facing upward, the last loop of knitting of the manufacture formed by the needle when it is pushed downward below the tab. The subsequent upward movement of the pick-up device causes the closing of the tabs on the needle head and the disengagement of the manufacture from the needles of the machine.

In order to perform the pick-up of the manufacture from the needles of the machine by means of the pick-up device of the type disclosed in the above mentioned international patent applications, the needles of the machine must be raised in the "dropped stitch" position and the last formed row of knitting must be held in the needle heads without passing below the tabs of the needles.

The pick-up device described above can be used in theory also to perform the pick-up of the manufacture from double-cylinder circular machines by arranging the manufacture inside the lower needle cylinder and bringing the loops of the last row of knitting in the upper head of the needles arranged in the lower needle cylinder and conveniently raised so as to allow the engagement of the pick-up elements with their stem below the upper tab of the same needles after the upper needle cylinder has been moved away from the lower needle cylinder.

The application of the pick-up device to single-cylinder circular hosiery machines, in order to perform the automated closure of the toe of hosiery, has not revealed problems, while its application to double-cylinder circular hosiery machines has been found to be more problematic, mainly because of the difficulty in arranging the manufacture correctly with the loops of the last row of knitting formed in the upper head of the needles arranged in the lower needle cylinder in the dropped-stitch position in order to allow simple and precise coupling with the pick-up elements of the pick-up device described above below the upper tab of the needles.

In fact, in double-cylinder circular hosiery machines, the presence of the sinkers, which are typically curved, contrasts the lifting of the manufacture together with the lifting of the needles into the dropped-stitch position in order to assuredly prevent the loops of the last row of knitting from passing below the upper tab of the needles arranged in the lower needle cylinder.

In double-cylinder circular hosiery machines, unlike single-cylinder circular hosiery machines, the sinkers are actuated by actuation cams which are fixed to a supporting element which is arranged inside the lower needle cylinder and is integral with the supporting structure of the machine as regards the movement of rotation about the axis of the lower needle cylinder. Such actuation cams define a path inside which a heel of the knockover sinkers, also termed sinkers hereinafter for the sake of simplicity, is engaged, and such path is shaped so as to cause cyclically, due to the rotation of the sinkers together with the lower needle cylinder about its own axis with respect to the supporting structure and therefore with respect to the actuation cams, a movement of the beak of each knockover sinker toward and away from the axis of the lower needle cylinder so as to cooperate with the adjacent needles in the formation of knitting. The path defined by the actuation cams of the sinkers is such as to cause a movement of the beak of the sinkers away from the axis of the lower needle cylinder at each feed or drop of the machine and cause a movement of the beak of the sinkers toward the axis of the lower needle cylinder in the remaining part of the rotation of the lower needle cylinder about its own axis. For this reason, at the end of the formation of the last row of knitting of the manufacture, the sinkers are engaged with the last row of knitting, except for the region at each feed or drop of the machine. The engagement of the sinkers with a substantial part of the last row of knitting of the produced manufacture prevents the lifting of the manufacture together with the needles of the machine in order to move the needles of the machine to the dropped-stitch position and maintain or move the loops of the last row of knitting formed in the upper head of the needles.

The aim of the present invention is to device a method for preparing a tubular manufacture such as a hosiery item or the like for automated pick-up at the end of its formation on a double-cylinder circular machine with at least one feed or drop and a double-cylinder circular machine for performing this method, which are capable of solving the above mentioned problem.

Within this aim, an object of the invention is to provide a method and a machine that make it possible to use, in order to perform the automated removal of the manufacture from the machine that has produced it and its transfer to a station in which the closure of an axial end of said manufacture is performed, a pick-up device provided with pick-up elements that can engage the stem of the needles below the upper tab of the needles, particularly of the type disclosed in WO2009/112346 and WO2009/112347.

Another object of the invention is to provide a method and a machine that make it possible to perform the pick-up of the manufacture from the machine at the end of its production in a very precise manner.

Another object of the invention is to propose a method and a machine that make it possible to perform the pick-up of the manufacture from the machine at the end of its production in a time that does not penalize excessively the productive potential of the machine.

This aim and these and other objects which will become better apparent hereinafter are achieved by a method for preparing a tubular manufacture such as a hosiery item or the like for automated pick-up at the end of its formation on a double-cylinder circular machine with at least one feed or drop, characterized in that it comprises at least the following steps:

- a first step, which consists in transferring or retaining all the needles in the lower needle cylinder with the loops of the last formed row of knitting of the manufacture engaged in the upper head of the needles, tensioning the manufacture downward inside the lower needle cylinder;
- a second step, which consists in moving all the needles to the tuck-stitch position;
- a third step, which consists in pushing upward the portion of the manufacture engaged with the needles;
- a fourth step, which consists in disengaging the sinkers from the manufacture so that said manufacture, due to the upward thrust, moves so that the loops of its last row of knitting are in the upper head of the needles;
- a fifth step, which consists in lifting the needles into the dropped-stitch position, keeping the manufacture pushed upward in order to keep the loops of the last row of knitting in the upper head of the needles.

The method according to the invention is performed by using a double-cylinder circular hosiery machine which comprises a supporting structure which rotatably supports a lower needle cylinder to rotate about its own axis, which is oriented vertically, and an upper needle cylinder positionable above and coaxially to the lower needle cylinder; a plurality of axial slots being defined on the lateral surface of said lower needle cylinder and on the lateral surface of said upper needle cylinder; each one of the axial slots of the lower needle cylinder, when said upper needle cylinder is arranged coaxially to said lower needle cylinder, being aligned with an axial slot of the upper needle cylinder and accommodating a needle that can perform a translational motion on command from said lower needle cylinder to said upper needle cylinder or vice versa; each one of the axial slots of said lower needle cylinder accommodating elements for actuating the corresponding needle when it is arranged in said lower needle cylinder, and each one of the axial slots of said upper needle cylinder accommodating elements for actuating the corresponding needle when it is arranged in said upper needle cylinder; around said lower needle cylinder and around said upper needle cylinder cams being provided for the actuation of the needles which can engage said actuation elements of the needles arranged in the axial slots of said lower needle cylinder and of said upper needle cylinder; knockover sinkers being accommodated inside said lower needle cylinder so that their beak lies between two contiguous axial slots and so that they can move with their beak toward and away from the axis of the lower needle cylinder; cams being provided for the actuation of the knockover sinkers that define at least one path that can be followed by a heel of the knockover sinkers as a consequence of the rotation of the lower needle cylinder with respect to said actuation cams of the knockover sinkers and is contoured to provide the movement of the knockover sinkers with their beak toward or away from the axis of the lower needle cylinder; characterized in that said actuation cams of the knockover sinkers are supported so that they can rotate by said supporting structure about the axis of said lower needle cylinder, means being provided for the actuation of said cams for actuating the knockover sinkers and being actuatable to provide a rotation, through an angle of preset breadth, of said actuation cams of the knockover sinkers about the axis of said lower needle cylinder with respect to said lower needle cylinder and said supporting structure.

Further characteristics and advantages of the invention will become better apparent from the description of a preferred but not exclusive embodiment of the method according to the invention and of the machine for performing it, illustrated by way of non-limiting example in the accompanying drawings, wherein.

Figure 1:
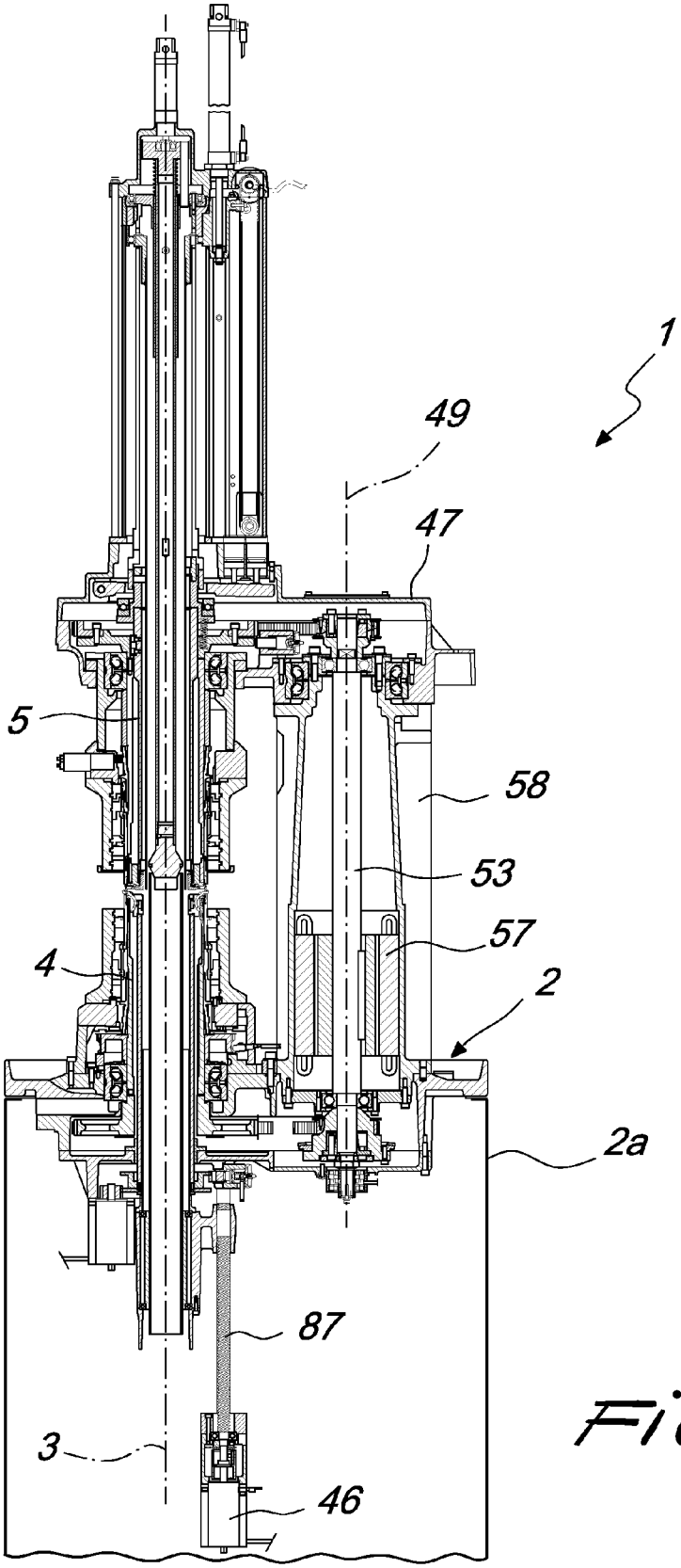
FIG. 1 is a schematic sectional view of the machine for performing the method according to the invention, taken along a vertical plane that passes through the axis of the lower needle cylinder and through the axis of the upper needle cylinder arranged above and coaxially to the lower needle cylinder.
Figure 2:
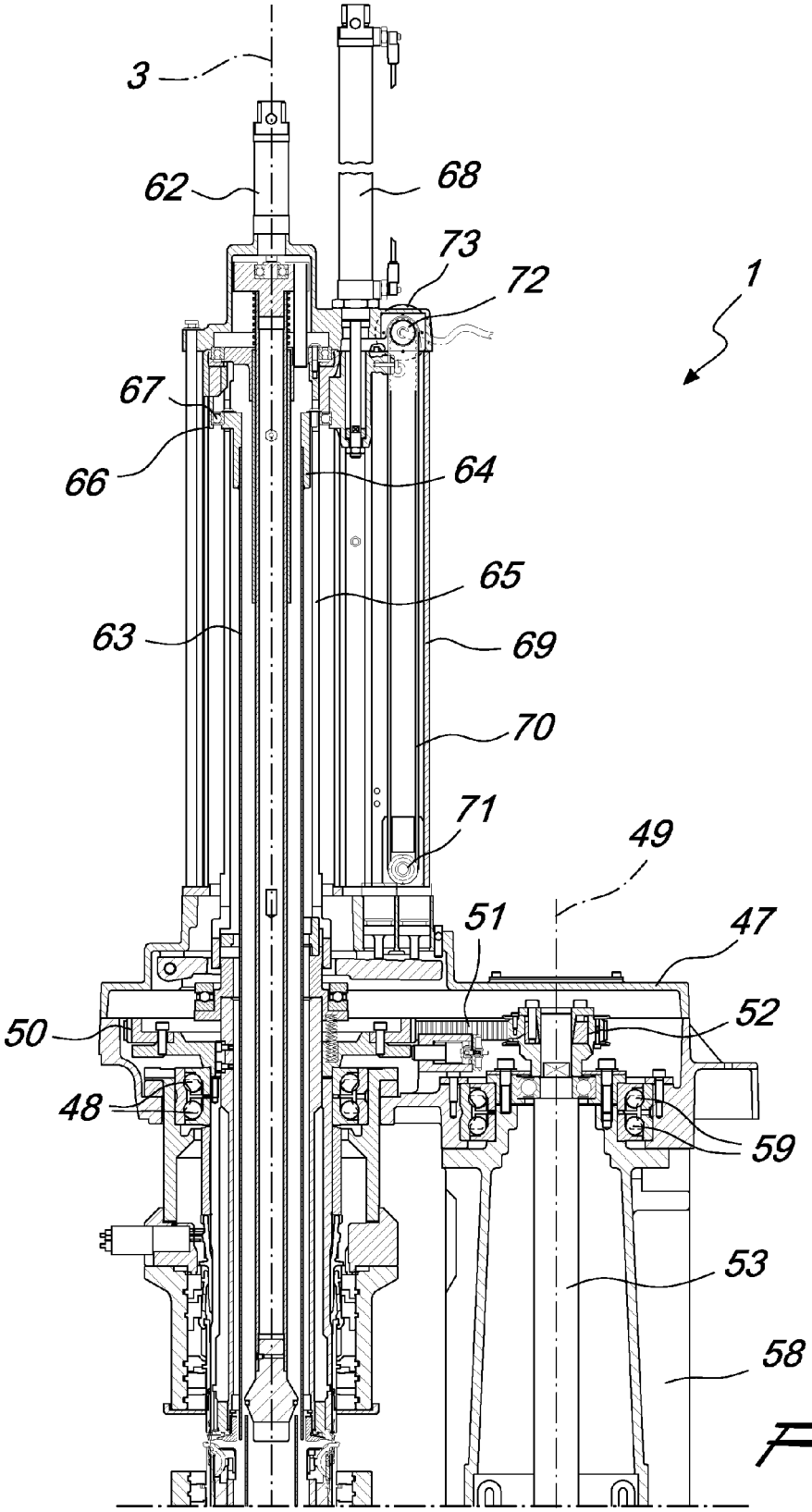
FIG. 2 is an enlarged-scale view of a detail of FIG. 1.
Figure 3:
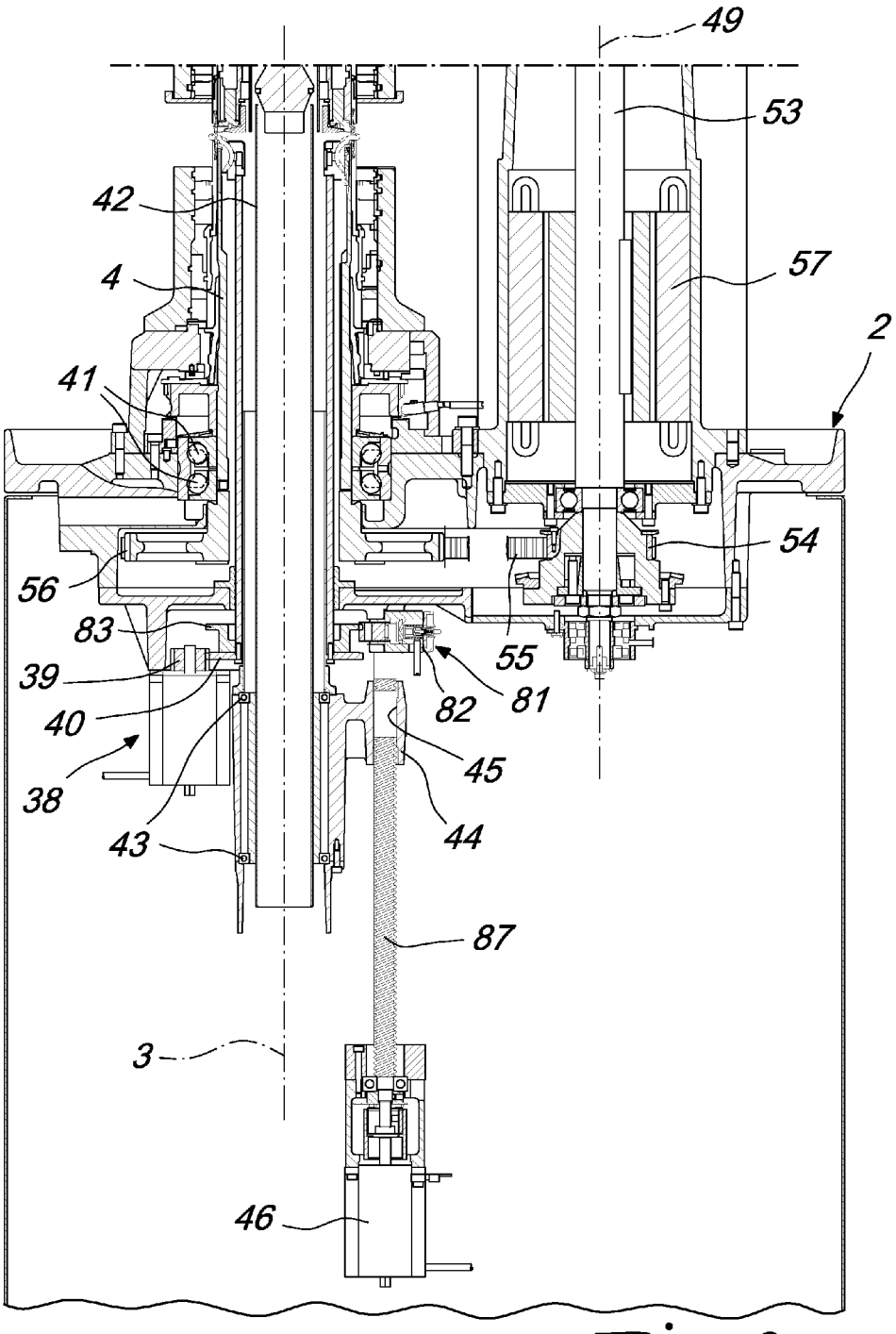
FIG. 3 is an enlarged-scale view of another detail of FIG. 1.

With reference to FIGS. 1 to 4, the machine for performing the method according to the invention, generally designated by the reference numeral 1, comprises a supporting structure 2 which is provided, in a per se known manner, with a footing 2*a* for resting on the ground and rotatably supports a lower needle cylinder 4 to rotate about its own axis 3, which is oriented vertically, and an upper needle cylinder 5, which is arranged above the lower needle cylinder 4 and can be arranged coaxially to the lower needle cylinder 4.

A plurality of axial slots 6, 7 is defined, in a per se known manner, on the lateral surface of the lower needle cylinder 4 and on the lateral surface of the upper needle cylinder 5. When the upper needle cylinder 5 is arranged above and coaxially to the lower needle cylinder 4, each one of the axial slots 6 of the lower needle cylinder 4 is aligned with a corresponding axial slot 7 of the upper needle cylinder 5 and accommodates a needle 8 which can perform a translational motion on command from the lower needle cylinder 4 to the upper needle cylinder 5 or vice versa. The needle 8 is provided, in a per se known manner, with an upper head 9*a* with a hook-like shape, by way of which the needle 8 can take threads and form knitting when the needle 8 is in the lower needle cylinder 4, and with a lower head 9*b* with a hook-like shape, by way of which the needle 8 can take threads and form knitting when the needle 8 is in the upper needle cylinder 5. Each head 9*a*, 9*b* of the needle 8 is provided with a tab 10*a*, 10*b*, which is pivoted to the stem of the needle 8 and can move about its own pivoting axis with respect to the stem of the needle 8 in order to open or close the corresponding head 9*a*, 9*b*.

Each one of the axial slots 6 of the lower needle cylinder 4 accommodates an element 11 for actuating the corresponding needle 8 when it is arranged in the lower needle cylinder 4. In the same manner, each one of the axial slots 7 of the upper needle cylinder 5 accommodates an element 12 for actuating the corresponding needle 8 when it is arranged in the upper needle cylinder 5.

The actuation elements 11, 12 of the needles 8 are actuated by cams for the actuation of the needles which are arranged respectively around the upper needle cylinder 5 and around the lower needle cylinder 4 and define paths that can be engaged by heels of the elements 11, 12 for actuating the needles 8 in order to actuate the actuation elements 11, 12, which in turn actuate the needles 8. The elements 11, 12 for actuating the needles 8 comprise, in a per se known manner, transfer plates 17, 18 also known as sliders.

More specifically, inside each axial slot of the lower needle cylinder 4 the actuation elements of the needles comprise a slider 17 provided, proximate to its upper end, with a hook for engaging the lower head 9*b* of the needle 8 and entraining the needle 8 in the lower needle cylinder 4 and for actuating it with a reciprocating motion along the corresponding axial slot 6 so that it takes the thread or threads fed to it at a feed or drop of the machine and forms knitting. The slider 17 is provided, along its extension, with at least one heel 17*a* which protrudes radially from the corresponding axial slot 6 and engages paths defined by cams 13 for actuating the sliders 17 which face the lateral surface of the lower needle cylinder 4 and are connected to the supporting structure 2 of the machine.

In a similar manner, in each axial slot 7 of the upper needle cylinder 5 there is a slider 18 which is provided, proximate to its lower end, directed toward the lower needle cylinder 4, with a hook for engaging the upper head 9*a* of the needle 8 and entraining it into the upper needle cylinder 5 and for actuating the needle 8 along the axial slot 7 so that it takes the thread or threads fed to it at a feed or drop of the machine and forms knitting. The slider 18 also is provided, along its extension, with at least one heel 18*a* which protrudes radially from the corresponding axial slot 7 and engages paths defined by cams 14 for the actuation of the sliders 18 which face the lateral surface of the upper needle cylinder 5 and are connected to the supporting structure 2 of the machine.

In the illustrated embodiment, the actuation elements 11, 12 of the needles 8, at least as regards the actuation elements 11 of the needles 8 arranged in the lower needle cylinder 4, are of the type illustrated in WO2007/113649 in the name of the same Applicant. Each one of the actuation elements 11, in the lower needle cylinder 4, comprises a connecting element 19 which is provided, on its side directed toward the outside of the lower needle cylinder 4, with a movable heel 19*a*. The connecting element 19 can oscillate on a radial plane of the lower needle cylinder 4 for the passage of the movable heel 19*a* from an active position, in which the movable heel 19*a* protrudes radially from the corresponding axial slot 6 of the lower needle cylinder 4 to engage corresponding cams 15 for the actuation of the connecting elements 19 which face the lateral surface of the lower needle cylinder 4 and define paths that can be followed by the movable heel 19*a*, in the active position, following the actuation of the lower needle cylinder 4 with a rotary motion about its axis 3 with respect to the actuation cams 15 of the connecting elements 19, to an inactive position, in which the movable heel 19*a* is contained in the corresponding axial slot 6 of the lower needle cylinder 4 so as to not engage the cams 15 for the actuation of the connecting elements 19, and vice versa. Each element 11 for actuating the needles 8 comprises, moreover, a selector 20 which has a portion that protrudes between the connecting element 19 and the bottom of the axial slot 6 of the lower needle cylinder 4 in which it is accommodated in any position that the connecting element 19 can assume during the operation of the machine. The selector 20 can oscillate on a radial plane of the lower needle cylinder 4 in order to actuate the transition of the movable heel 19*a* of the connecting element 19 from the inactive position to the active position cited above.

Each connecting element 19 is connected to the lower end of the slider 17 arranged in the same axial slot 6 of the lower needle cylinder 4.

Figure 4:
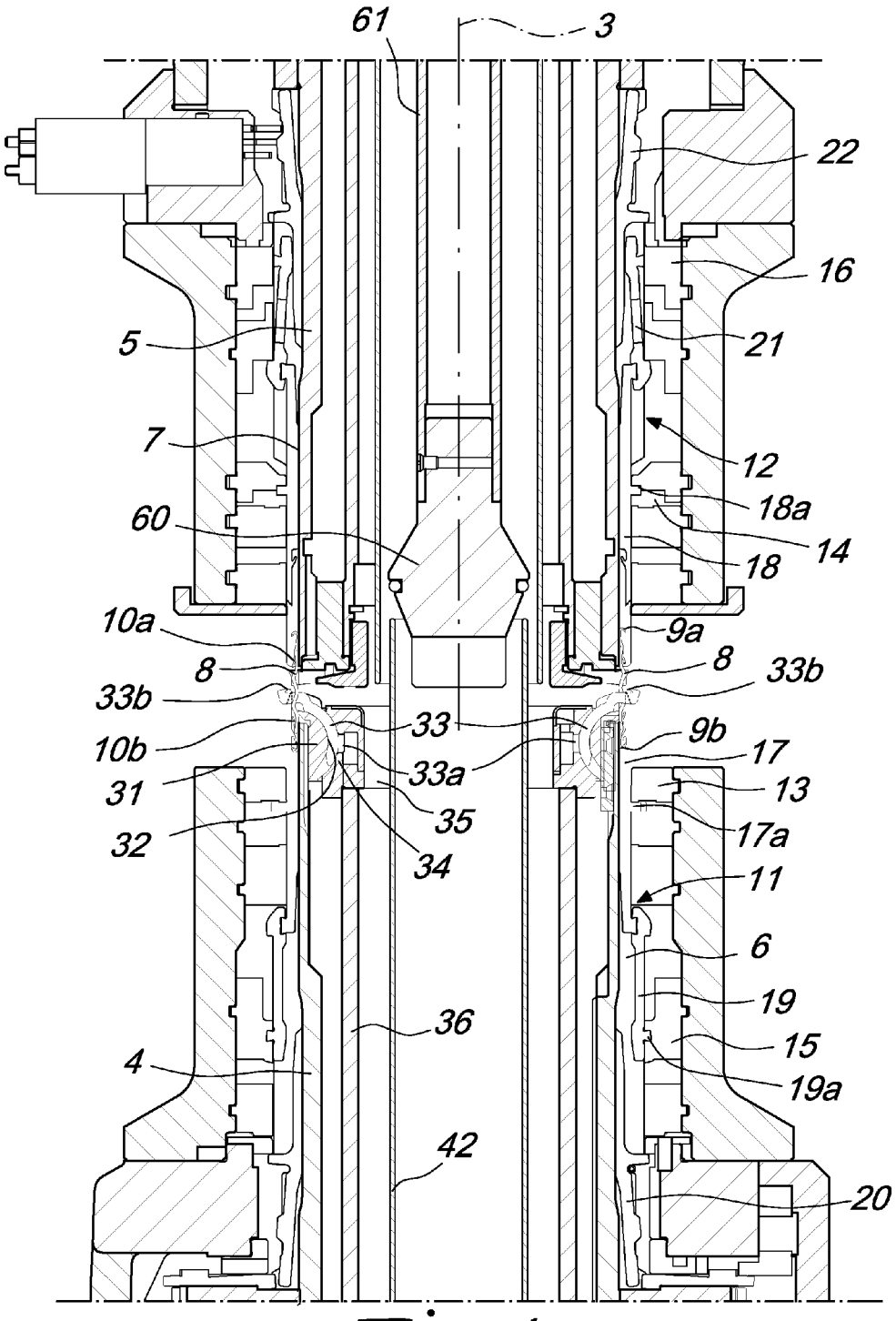
FIG. 4 is a further enlarged-scale view of a detail of FIG. 1.

The elements 12 for actuating the needles 8 arranged in the upper needle cylinder 5 can be provided and actuated, as illustrated in FIGS. 1 to 4, in the same manner as the elements 11 for actuating the needles 8 arranged in the lower needle cylinder 4. In FIG. 4, the connecting elements arranged in the upper needle cylinder 5 have been designated by the reference numeral 21, the corresponding actuation cams by the reference numeral 16 and the selectors by the reference numeral 22.

For a better understanding of the elements 11, 12 for actuating the needles 8 and of their operation, reference should be made to WO2007/113649, assumed included herein by way of reference.

As illustrated in FIGS. 5 to 17, the cams 13 for the actuation of the sliders 17 arranged in the lower needle cylinder 4 comprise a set of cams termed knitting forming cams, which is arranged at a feed or drop of the machine. Such set of cams comprises, as in machines of the known type: a central triangle 23, a first knockover cam 24, which operates when the lower needle cylinder 4 rotates in one direction or forward direction, designated by the arrow 30 in FIGS. 5 to 17, a second knockover cam 25, which is arranged symmetrically to the first knockover cam 24 with respect to the central triangle 23 and operates when the lower needle cylinder 4 rotates in the opposite direction or return direction, a first dropped-level lifting cam 26, which operates when the lower needle cylinder 4 rotates in one direction or forward direction 30, and a second dropped-level lifting cam 27, which is arranged symmetrically to the first dropped-level lifting cam 26 with respect to the central triangle 23 and operates when the lower needle cylinder 4 rotates in the opposite direction or return direction.

The cams 13 for actuating the sliders 17, which are arranged in the lower needle cylinder 4, also comprise a first lifting cam 28, which is arranged downstream of the first knockover cam 24 along the forward direction 30 of the lower needle cylinder 4, and a second lifting cam 29, which is arranged proximate to the second dropped-level lifting cam 27.

The central triangle 23, the first knockover cam 24, the second knockover cam 25, the first dropped-level lifting cam 26, the second dropped-level lifting cam 27, the first lifting cam 28 and the second lifting cam 29 can move on command toward or away from the axis 3 of the lower needle cylinder 4 so as to interfere or not interfere with the heels 17*a* of the sliders 17.

As in machines of the known type, the sliders 17, which are arranged approximately in one half of the lower needle cylinder 4, are provided with a long heel, while the sliders 17 arranged in the remaining part of the lower needle cylinder 4 are provided with a short heel in order to allow the typical knitting of hosiery at the toe and heel. At least some of the cams cited above can be moved closer to the lower needle cylinder 4 in two active positions, mutually spaced at right angles to the axis 33 of the lower needle cylinder 4, respectively: a first active position, in which it is spaced from the lateral surface of the lower needle cylinder 4 so as to interfere only with the heels of the sliders 17 provided with a long heel, and a second active position, in which it is closer to the lateral surface of the lower needle cylinder 4 than the first active position, so as to interfere both with the heels of the sliders 17 provided with a long heel and with the heels of the sliders 17 provided with a short heel.

A sinker ring 31 is arranged inside the lower needle cylinder 4, proximate to its upper end, and a plurality of arc-like slots 32 is provided therein. Each slot is arranged between two adjacent axial slots 6. A knockover sinker 33, also termed hereinafter sinker for the sake of simplicity, is accommodated inside each one of the arc-like slots 32 and is provided, at one of its upper ends, with a beak 33*b* which, by means of the sliding of the knockover sinkers 33 inside the corresponding arc-like slot 32, can move toward or away from the axis 3 of the lower needle cylinder 4. More specifically, the beak 33*b* of each sinker 33 is arranged at the upper end of the axial slots 6 defined in the lateral surface of the lower needle cylinder 4 and is directed toward the axis 3 of the lower needle cylinder 4. Each sinker 33 has, in an intermediate region of its extension, a heel 33*a* which protrudes from the corresponding arc-like slot 32 and engages in a path defined by cams 34 for actuating the sinkers 33 which are fixed to an annular supporting element 35 arranged internally and coaxially to the lower needle cylinder 4 proximate to its upper end.

The path defined by the cams 34 for actuating the sinkers 33 is shaped so as to cause a reciprocating motion of the sinkers 33 along the corresponding arc-like slots 32 due to the rotational movement of the sinkers 33, integrally with the lower needle cylinder 4 about its axis 3 with respect to the supporting structure 2 of the machine. In particular, the shaped path is such to cause, during the formation of the manufacture, a movement of the beak 33*b* of the sinkers 33 away from the axis 3 of the lower needle cylinder 4 which straddles the first knockover cam 24 of each feed or drop of the machine and a movement of the beak 33*b* of the sinkers 33 toward the axis 3 of the lower needle cylinder 4 in the remaining part of the rotation of the lower needle cylinder 4 about its axis 3.

By means of the reciprocating motion of each sinker 33 inside the corresponding arc-like slot 32, during the formation of the manufacture, the beak 33*b* of each sinker 33 moves closer to the axis 3 of the lower needle cylinder 4, engaging the region of knitting arranged between two adjacent needles 8 and tensioning the loops of knitting formed by the needles 8 against the stem of the needles 8 while they are lifted to the dropped-stitch position in order to take the thread fed at a feed of the machine. In the dropped-stitch position, the needle 8 is lifted to such a level that the loop of knitting previously formed, kept by the sinkers 33 against the stem of the needle, is below the upper tab 10*a* of the needle 8. Subsequently, the beak 33*b* of the sinker 33 moves away from the axis 3 of the lower needle cylinder 4 while the needles 8 descend inside the corresponding axial slot of the lower needle cylinder 4, forming new loops of knitting and knocking over, i.e., abandoning, the loops of knitting formed previously, which are therefore knitted in with the new loops of knitting.

The supporting element 35 is fixed to the upper end of a sleeve 36 which is accommodated internally and coaxially to the lower needle cylinder 4. The sleeve 36 is supported, so that it can rotate about its own axis, which coincides with the axis 3 of the lower needle cylinder 4, in the lower needle cylinder 4 and protrudes, with its lower end, from the lower end of the lower needle cylinder 4.

Conveniently, actuation means 37 are provided for turning through a preset angle the cams 34 for actuating the sinkers 33 about the axis 3 of the lower needle cylinder 4 with respect to the lower needle cylinder 4 and to the supporting structure 2. The actuation means 37 comprise an actuator 38 which is associated with the supporting structure 2 and is connected to the sleeve 36.

The actuator 38 can be constituted, according to requirements, by an electric motor, preferably a step motor, which is connected, by means of its output shaft, to a pinion 39 which meshes with a gear 40 which is fixed coaxially to the lower end of the sleeve 36. By means of the actuation of the electric motor, which constitutes the actuator 38, it is possible to cause the rotation, through an angle of any breadth, even a complete rotation, of the sleeve 36 and therefore of the cams 34 for actuating the sinkers 33.

As an alternative, the actuator 38 can be constituted by a fluid-operated cylinder, in which the stem of its piston is fixed to a rack that meshes with the gear 40 which is fixed coaxially to the lower end of the sleeve 36. In this case also, by means of the actuation of the fluid-operated cylinder it is possible to cause the rotation, through an angle of any breadth, even a complete rotation, of the sleeve 36 and therefore of the cams 34 for actuating the sinkers 33.

Conveniently, means 81 are provided for blocking the rotation of the sleeve 36 during the normal operation of the machine in the production of the manufactures.

The blocking means 81 comprise a fluid-operated cylinder 82, which is connected by means of its body to the supporting structure 2 and is connected by means of the stem of its piston to a pin which can engage a notch defined in an annular element 83 which is fixed coaxially to the portion of the sleeve 36 that protrudes downward from the lower needle cylinder 4. In practice, the actuation of the fluid-operated cylinder 82 blocks the possibility of rotation of the sleeve 36 and therefore keeps the cams 34 for actuating the sinkers 33 blocked in a preset angular position during the production cycle of the manufacture.

The lower needle cylinder 4 is supported by the supporting structure 2 so that it can rotate about its axis 3, which is oriented vertically, by means of a pair of bearings 41.

A pusher and suction tube 42 that is jointly connected to the lower needle cylinder 4 in rotation about its axis 3 is arranged internally and coaxially to the lower needle cylinder 4. The pusher and suction tube 42 can be connected to a suction duct, not illustrated for the sake of simplicity, and is adapted to receive the manufacture starting from its axial end that lies opposite with respect to the axial end engaged with the needles 8.

The pusher and suction tube 42 protrudes, with its lower end, from the lower end of the lower needle cylinder 4 and, at its lower end portion arranged externally to the lower needle cylinder 4, is supported, so that it can rotate about its own axis, by means of the interposition of a pair of bearings 43, by a block 44. The block 44 couples, by means of a coupling of the screw-and-nut type 45, to a threaded stem 87 which is oriented parallel to the axis 3 of the lower needle cylinder 4 and is fixed to the output shaft of an electric motor 46, for example a step motor.

In this manner, by actuating the electric motor 46 the pusher and suction tube 42 is moved along the axis 3 of the lower needle cylinder 4 with respect to the lower needle cylinder 4.

The length of the pusher and suction tube 42 with respect to the length of the lower needle cylinder 4 is such that the upper end of the pusher and suction tube 42 is arranged proximate to the upper end of the lower needle cylinder 4, i.e., proximate to the working region of the needles 8 of the machine. By means of the axial movement of the pusher and suction tube 42 with respect to the lower needle cylinder 4, it is possible to move the upper end of the pusher and suction tube 42 completely inside the lower needle cylinder 4 or move the upper end of the pusher and suction tube 42 to protrude upward from the upper end of the lower needle cylinder 4 in order to push the manufacture upward, as will be described better in detail hereinafter.

The upper needle cylinder 5 is supported, so that it can rotate about its own axis, which is oriented vertically, by an arm 47 by means of a pair of bearings 48. The arm 47 in turn is supported, by means of a pair of bearings 59, so that it can rotate about an axis 49 which is parallel and spaced from the axis 3 of the lower needle cylinder 4, by a post 58, which is fixed to the supporting structure 2. The arm 47 can rotate on command about the axis 49 so as to make it possible to move the upper needle cylinder 5 above and coaxially to the lower needle cylinder 4 or in a position which is spaced laterally from the lower needle cylinder 4. The upper needle cylinder 5 is connected kinematically to the lower needle cylinder 4 by means of a first sprocket wheel 50, which is fixed coaxially to the upper needle cylinder 5 and is connected, by means of a first toothed belt 51, to a second sprocket wheel 52, which is keyed to the upper end of a connecting shaft 53 which is arranged parallel to the axis 3 of the lower needle cylinder 4. A third sprocket wheel 54 is keyed at the lower end of the connecting shaft 53 and is connected, by means of a second toothed belt 55, to a fourth sprocket wheel 56, which is fixed coaxially to the lower needle cylinder 4.

Preferably, the connecting shaft 53 constitutes the shaft of the main electric motor 57 of the machine, which is arranged laterally to the lower needle cylinder 4 inside the post 58, which, by means of the arm 47, supports the upper needle cylinder 5, as disclosed in WO2012/072296 in the name of the same Applicant.

Inside the upper needle cylinder 5, proximate to the lower end thereof, a manufacture blocking element 60 is provided, which can engage the upper end of the pusher and suction tube 42. The blocking element 60 is plug-shaped and is fixed to the lower end of a stem 61 which is arranged internally and coaxially to the upper needle cylinder 5 and is connected, with its upper end, to the stem of the piston of a fluid-operated cylinder 62 connected to the upper end of the upper needle cylinder 5. By means of the actuation of the fluid-operated cylinder 62, when the upper needle cylinder 5 is arranged above and coaxially to the lower needle cylinder 4, the movement of the stem 61 and therefore of the blocking element 60 along the axis 3 of the lower needle cylinder 4 is produced, causing its engagement with the upper end of the pusher and suction tube 42 or its disengagement from the upper end of the pusher and suction tube 42.

A tensioning tube 63 is arranged internally and coaxially to the lower needle cylinder 4, around the stem 61 and the blocking element 60, and is fixed with its upper end to an internal sleeve 64 which can slide partially inside a guiding tube 65, which is arranged coaxially to the upper needle cylinder 5 and is fixed integrally to the upper end of the upper needle cylinder 5. The internal sleeve 64 is connected, by passing through at least one axial slot which passes through the lateral surface of the guiding tube 65, to an external sleeve 66 with the interposition of a bearing 67, so that the internal sleeve 64, together with the tensioning tube 63, can rotate jointly with the upper needle cylinder 5 while the external sleeve 66 is not affected by this rotation. The external sleeve 66 is connected to the stem of a fluid-operated cylinder 68, which is fixed by means of its body to a supporting element fixed to the arm 47 that supports the upper needle cylinder 5. The actuation of the fluid-operated cylinder 68 causes the sliding, along the axis of the upper needle cylinder 5, of the external sleeve 66, of the internal sleeve 64 and of the tensioning tube 63. Moreover, the stem of the fluid-operated cylinder 68 is connected to a toothed belt 70, which mutually connects two sprocket wheels 71, 72 with horizontal and mutually parallel axes. The sprocket wheel 72 is connected to an encoder 73, by means of which it is possible to detect constantly, and with high precision, the movement of the tensioning tube 63 along the axis of the upper needle cylinder 5.

In practice, at the beginning of the formation of the manufacture, the first produced axial end of the manufacture is aspirated into the upper end of the pusher and suction tube 42 and is blocked with respect to the pusher and suction tube 42 by the engagement of the blocking element 60 against the upper end of the pusher and suction tube 42. During the formation of the manufacture, the tensioning tube 63 is progressively lowered so as to engage, with its lower end, the portion of the manufacture that extends from the upper end of the pusher and suction tube 42 to the needles 8 of the machine that are forming it. The lowering of the tensioning tube 63 ensures the tensioning of the manufacture during its formation and this tensioning can be controlled by means of the detection of the lowering of the tensioning tube 63 performed by means of the encoder 73.

The operation of the machine described above, in the execution of the method according to the invention, will now be detailed with particular reference to FIGS. 5 to 17, which illustrate a portion of the machine related to the lower needle cylinder 4, showing the cams 15 for actuating the connecting elements 19 and the cams 13 for actuating the sliders 17 arranged in the axial slots 6 of the lower needle cylinder 4. The set of cams has been extended flat and their illustration has been limited to a region of the machine proximate to a feed or drop that is used to prepare the manufacture for its removal from the machine at the end of the production cycle. The set of the elements that actuate the needles 8, i.e., the selectors 20, the connecting elements 19 and the sliders 17, as well as the needles 8, have been shown in phantom lines and are rotated through 90° about their axis with respect to their actual position in relation to the set of cams.

For the sake of simplicity in description, the set of the cams for actuating the connecting elements 19 has been generally designated by the reference numeral 15, while the set of the cams for actuating the sliders 17 has been generally designated by the reference numeral 13.

FIGS. 5 to 17 also show indicatively the path 78 defined by the cams 34 for actuating the sinkers 33 and the portion of the path 78 that causes the movement of the beak 33*b* of the sinkers 33 away from the axis 3 of the lower needle cylinder 4 has been designated by the reference numeral 78*a*.

In these figures, the last row of knitting formed by the needles 8 has been illustrated with a thicker line and designated by the reference numeral 80.

Proximate to the feed or drop being considered two selection regions 75 and 76 are provided, which are arranged respectively upstream and downstream of the feed being considered, according to the forward direction of rotation 30 of the lower needle cylinder 4 about its own axis 3. Actuators are arranged at the selection regions 75 and 76 and can be actuated in order to cause, by means of the oscillation of the selectors 20, the passage of preset connecting elements 19 from the inactive position to the active position, in a per se known manner.

The direction of rotation of the lower needle cylinder 4 with respect to the set of cams is indicated in FIGS. 5 to 17 by the arrow 30.

The expression "dropped-stitch position" designates the position in which the needle 8 is arranged with its upper tab 10*a* above the knitting forming plane or knockover plane, designated in FIGS. 5 to 17 by the reference numeral 77, which is the plane defined by the sinkers 33 on which the thread taken by the needles 8 lies while the needles 8 are lowered into the lower needle cylinder 4 in order to form new loops of knitting. When the needle 8 reaches this position, its upper head 9*a* is at such a level as to take the thread or threads supplied at a feed or drop of the machine. In this position of the needle 8, if the sinkers 33 were engaged with the manufacture as occurs during the production of the manufacture, the last formed loop of knitting would descend on the stem of the needle 8 below the upper tab 10*a* of the needle 8.

The expression "tuck-stitch position" designates the position in which the needle 8 is raised, but to a lesser extent than the dropped-stitch position. In the tuck-stitch position, the free end of the upper tab 10*a*, which is completely open, is arranged below the knitting forming plane or knockover plane 77. When the needle 8 reaches this position, its upper head 9*a* is at such a level that it can take the thread or threads supplied at a feed or drop of the machine, but the last formed loop of knitting does not descent below the upper tab 10*a* of the needle 8.

The expression "floating-stitch position" designates the position in which the needle 8 is lowered with its upper head 9*a* below the knitting forming plane or knockover plane 77.

In a first step of the method, before the formation of the last row of knitting, or rather of a few final rows of knitting of the manufacture, the needles 8 of the machine that due to requirements of previous work have been transferred into the upper needle cylinder 5 are returned into the lower needle cylinder 4 so that during the execution of the final row or few final rows of knitting of the manufacture, all the needles of the machine are arranged in the lower needle cylinder 4 and engage the loops of the last row of knitting, which they formed, in the upper head 9*a* of the needles 8.

If, due to requirements of previous work, the tensioning tube 63 has been lowered into the lower needle cylinder 4 in order to tension the blocked manufacture, with its first formed axial end, between the blocking element 60 and the upper end of the pusher and suction tube 42, one proceeds by disengaging the blocking element 60 from the upper end of the pusher and suction tube 42 and by retracting progressively the tensioning tube 63 upward until it is extracted completely from the upper end of the lower needle cylinder 4, while the pusher and suction tube 42, whose upper end is below the upper end of the lower needle cylinder 4, is connected to a suction duct so as to draw progressively the manufacture into it and keep it properly tensioned downward.

In a second step of the method, after the needles 8 have taken the thread at the feed being considered to form the loops of the last row of knitting 80, by means of the first lifting cam 28, they are all brought to the tuck-stitch position.

Figure 5:
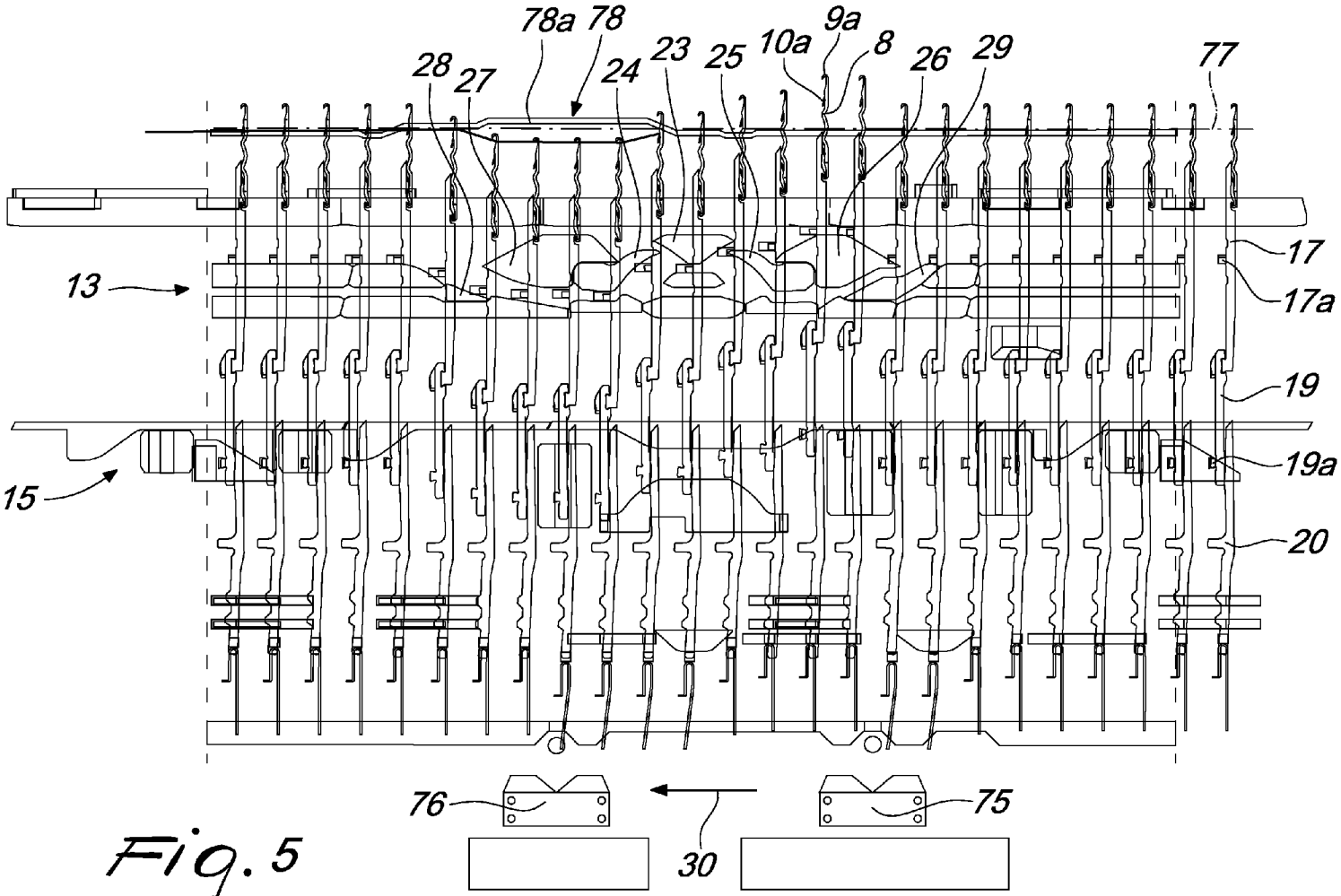
FIGS. 5 to 17 are schematic views of the actuation of the machine during the execution of the method according to the invention with reference to a portion of the lower needle cylinder proximate to a feed or drop of the machine and with the set of the actuation cams of the needles extended flat.
Figure 6:
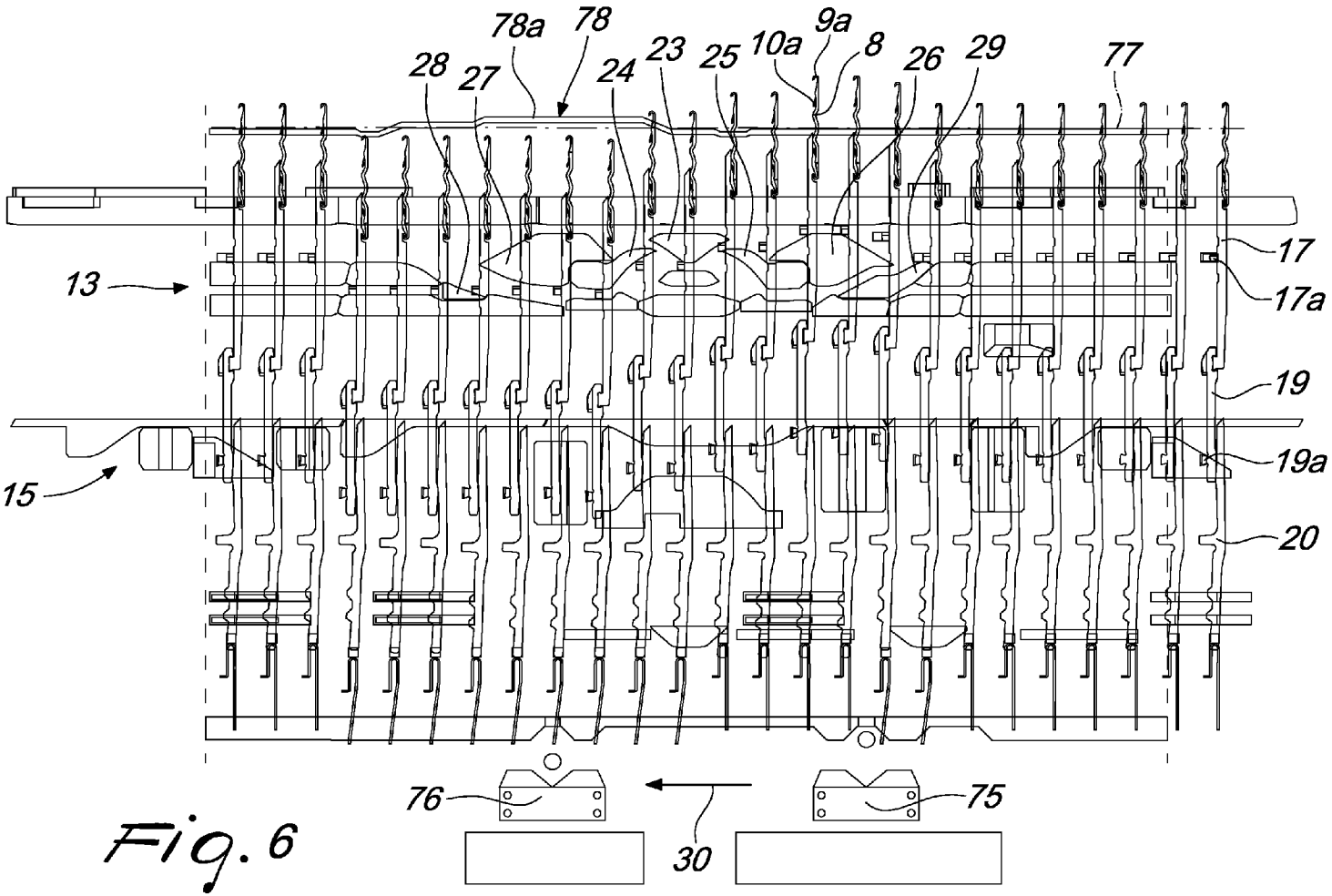
Figure 7:
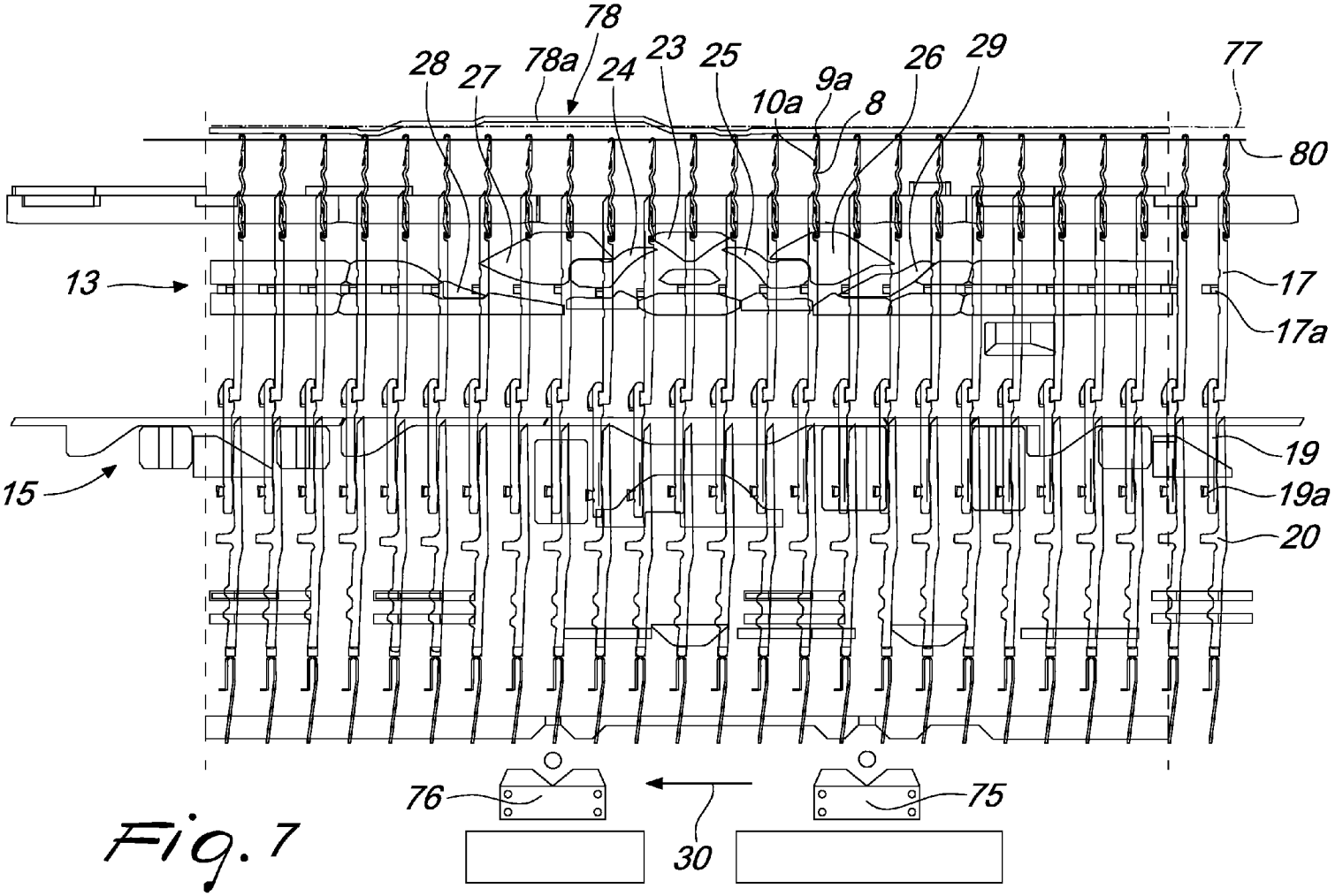

More specifically, as shown in FIG. 5, during the formation of the last row of knitting 80 the first lifting cam 28, starting from the second active position, in which it interferes both with the sliders 17 provided with long heels and with the sliders 17 provided with short heels, is brought to the first active position so as to interfere only with the sliders 17 provided with a long heel. As a consequence of the engagement with the first lifting cam 28, the sliders 17 provided with a long heel are thus lifted, bringing the needles 8 with which they are engaged to the tuck-stitch position after the needles 8 have taken the thread and formed the loops of the last row of knitting 80, while the sliders 17 provided with a short heel, by not engaging the first lifting cam 28, are lowered, lowering the needles 8 with which they are engaged to the floating-stitch position.

Subsequently, the first lifting cam 28 is brought to the inactive position so as not to interfere with the sliders 17 provided with a short heel and with the sliders 17 provided with a long heel, while the second lifting cam 29 and the first dropped-level lifting cam 26 are brought first to the first active position (FIG. 6), so as to interfere only with the sliders 17 provided with a long heel, and then in the inactive position (FIG. 7) so as to not interfere even with sliders 17 provided with a short heel. In this manner, the needles 8 are all brought to the floating-stitch position.

In the floating-stitch position, the needles 8 have their upper head 9*a* below the knitting forming plane 77 and therefore below the beak 33*b* of the sinkers 33 that are close with their beak 33*b* to the axis 3 of the lower needle cylinder 4 with the exception of the sinkers 33 that are arranged proximate to the feed or feeds of the machine.

At this point, the rotation of the needle cylinders 4, 5 is stopped and the upper needle cylinder 5 is moved away from the lower needle cylinder 4 so as to free the upper end thereof. The upper needle cylinder 5 is preferably moved away by turning the arm 47 about the axis 49 so that the upper needle cylinder 5 is arranged laterally to the lower needle cylinder 4.

Figure 8:
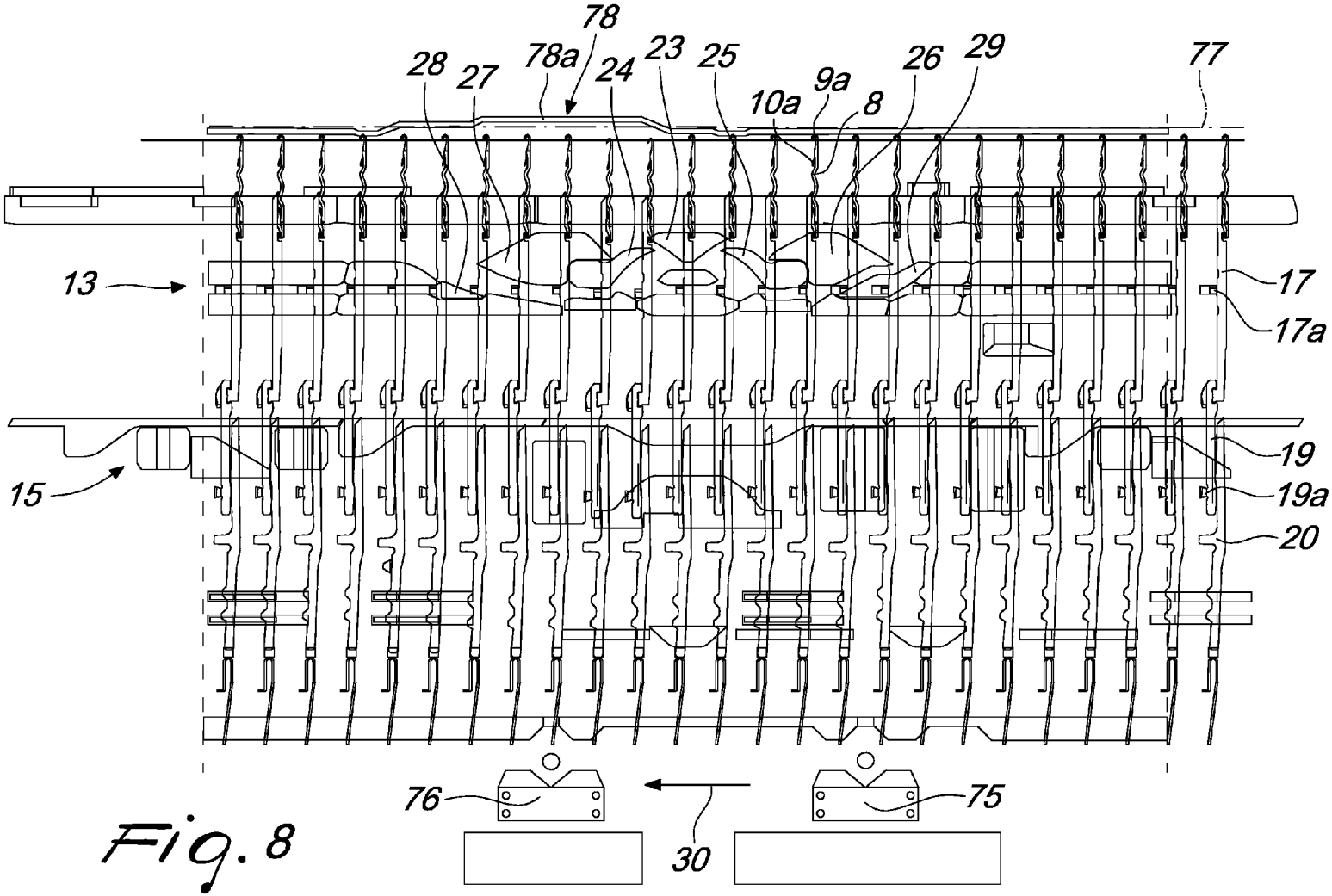
Figure 9:
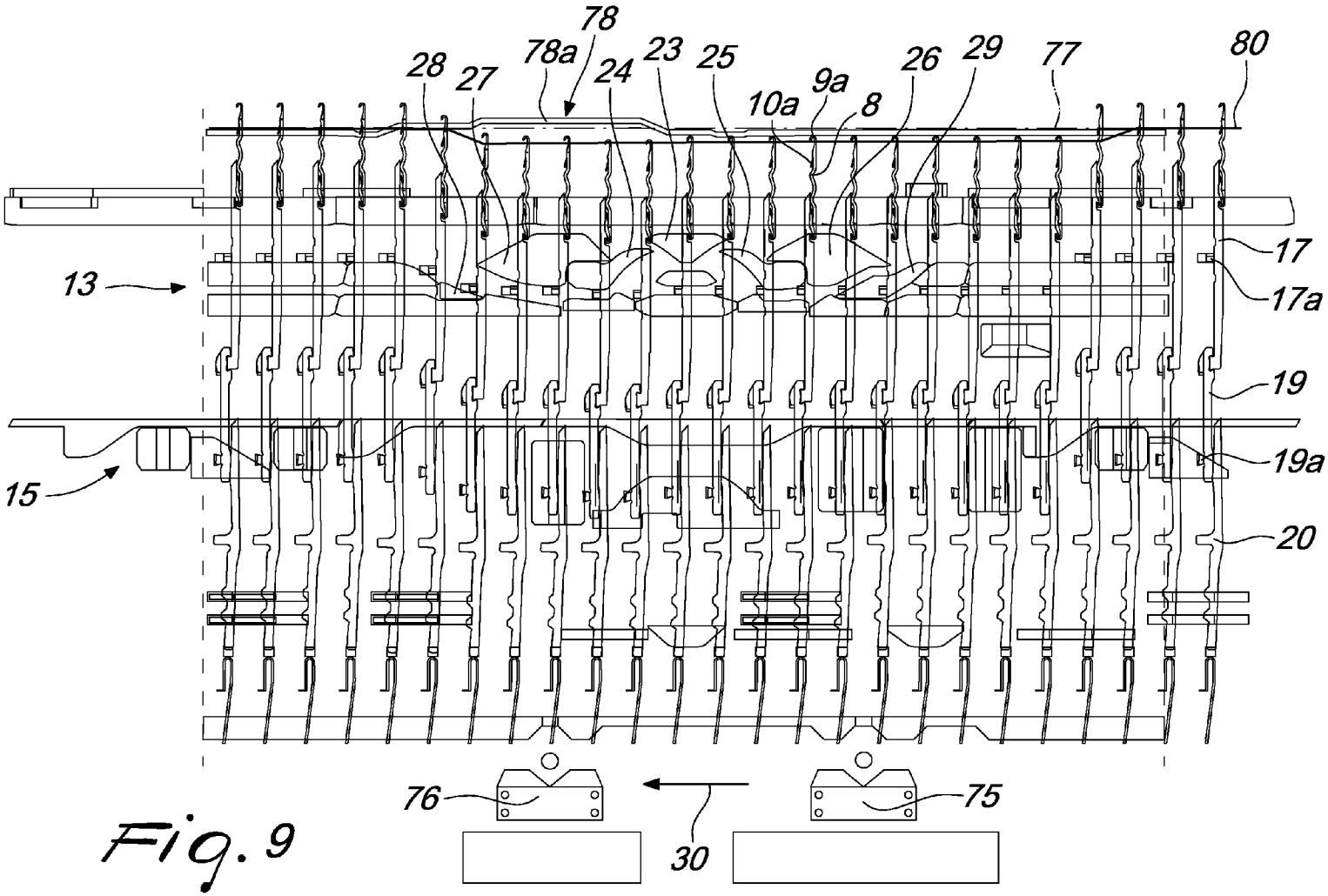

Subsequently, the actuation of the lower needle cylinder 4 with a rotary motion about its axis 3, which is aimed at completing the second step, i.e., at bringing all the needles 8 to the tuck-stitch position, resumes. The passage of the needles 8 from the floating-stitch position to the tuck-stitch position is performed in two stages in order to avoid breaking the heels of the sliders 17. More specifically, while the sliders 17 provided with a short heel are passing at the first lifting cam 28, the first lifting cam 28 is moved from the inactive position to the first active position, so as to not interfere with the short heels and be instead engaged by the sliders 17 provided with a long heel, which are lifted, bringing the corresponding needles 8 in the tuck-stitch position. Subsequently, the first lifting cam 28 is moved from the first active position to the second active position so as to engage also the sliders 17 provided with a short heel, which are also lifted, causing the passage of the corresponding needles 8 to the tuck-stitch position (FIGS. 8 and 9). In this step, the knockover cams 24, 25, the central triangle 23 and the second dropped-level lifting cam 27 are brought to the inactive position so as to not interfere with the sliders (FIG. 9).

Figure 10:
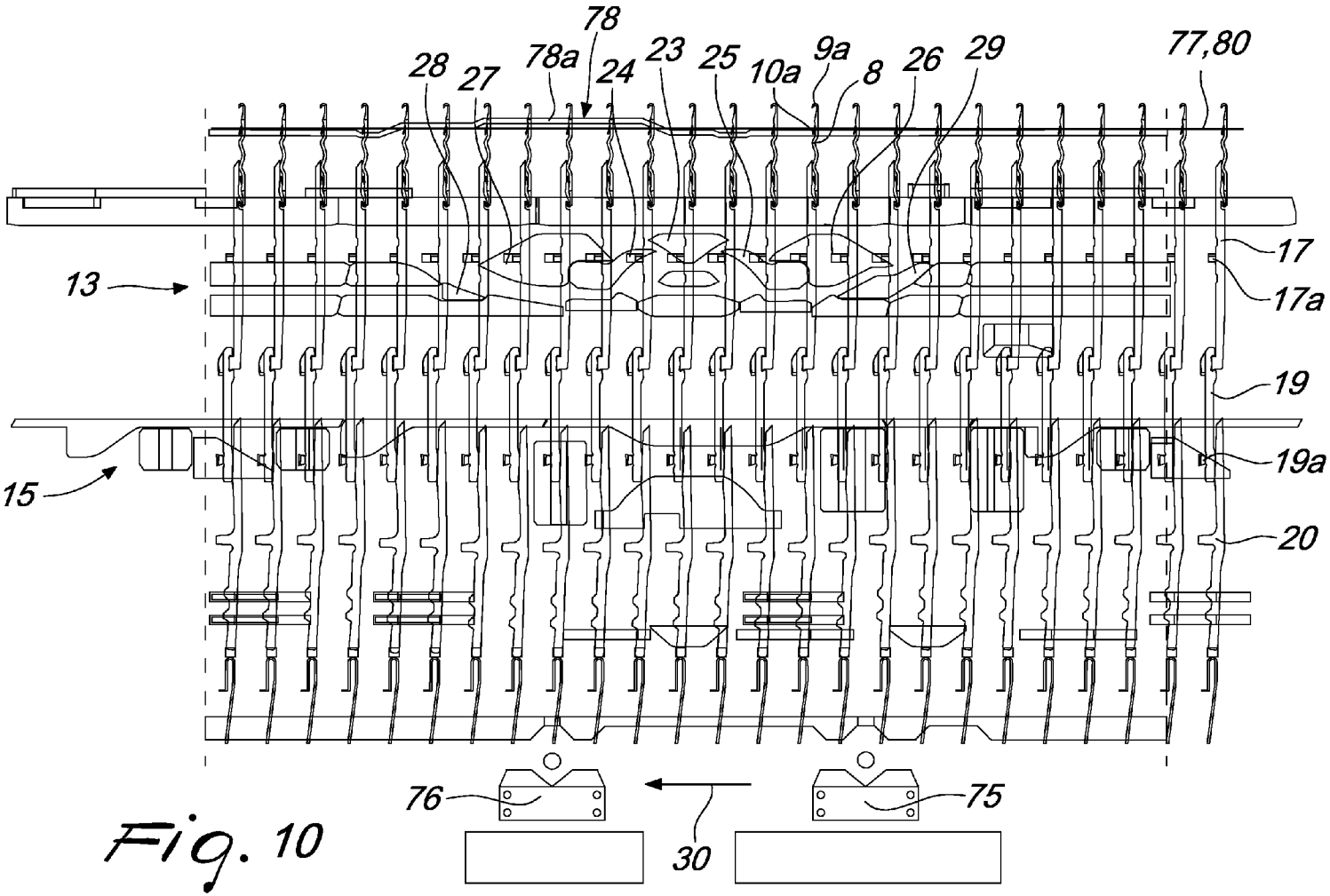

At this point, all the needles 8 are in the tuck-stitch position (FIG. 10). In this position, the loops of the last row of knitting 80 formed by the needles 8 are at the upper tab 10*a* of each needle 8 without passing on the stem of the needle 8 below it.

In a third step of the method, the rotation of the lower needle cylinder 4 is stopped and, by means of the lifting of the pusher and suction tube 42 until its upper end is above the upper end of the lower needle cylinder 4, the portion of manufacture that is engaged with the needles 8 is pushed upward. It should be noted that the upward thrust applied by the pusher and suction tube 42 on the manufacture is not sufficient to move all the loops of the last row of knitting 80 formed in the upper head 9*a* of the needles 8, because much of the last row of knitting 80, as noted above, is engaged by the sinkers 33 that are close to the axis 3 of the lower needle cylinder 4 with their beak 33*b*.

Figure 11:
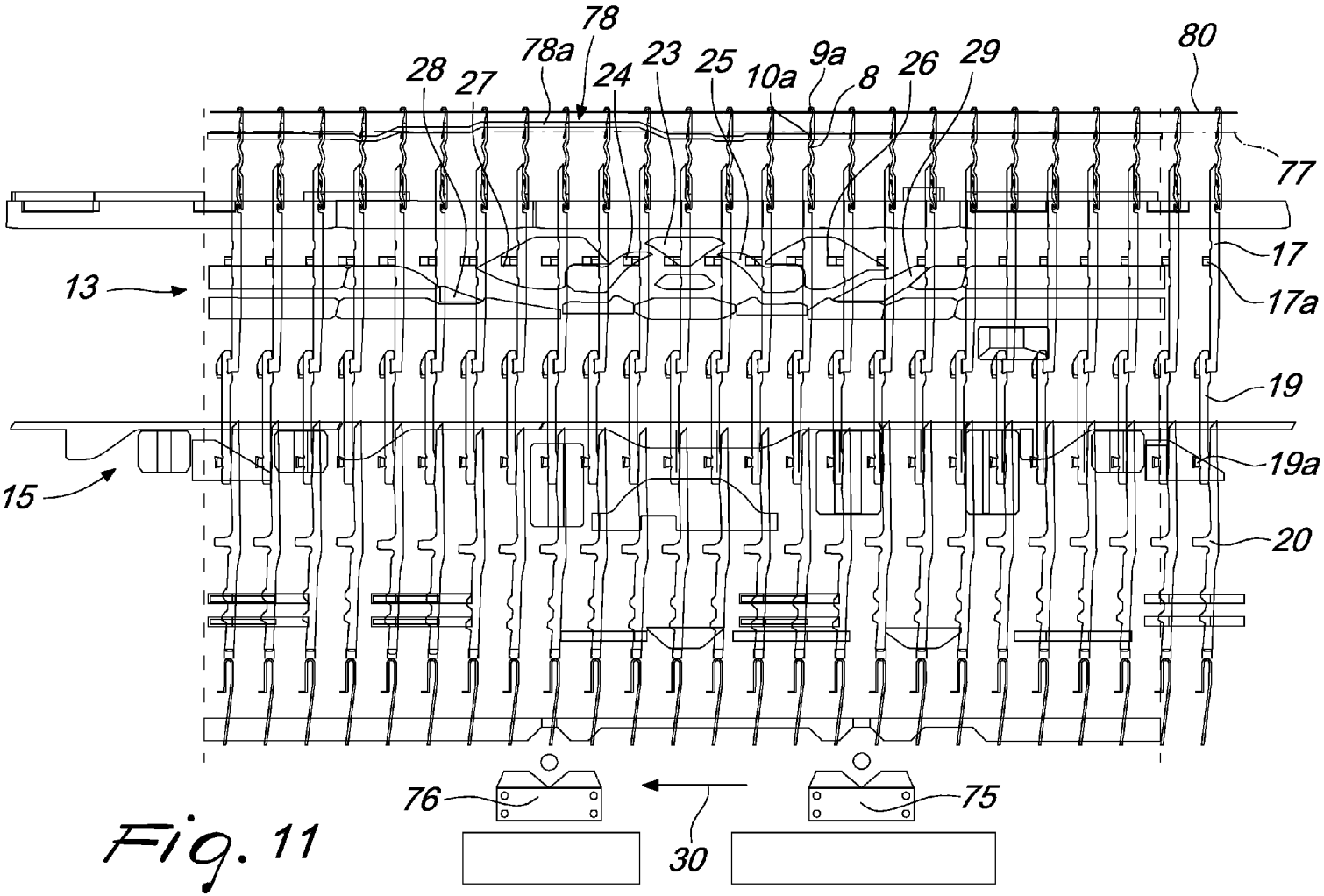

In a fourth step of the method, the sinkers 33 are disengaged from the manufacture so that the manufacture, due to the upward thrust, moves with the loops of its last row of knitting 80 into the upper head 9*a* of the needles 8 (FIG. 11). The disengagement of the sinkers 33 from the manufacture is performed by actuating the actuator 38 so as to cause a substantially complete rotation of the cams 34 for actuating the sinkers 33 about the axis 3 of the lower needle cylinder 4 with respect to the lower needle cylinder 4 while the lower needle cylinder 4 is stationary. Because of this rotation of the cams 34 for actuating the sinkers 33, the sinkers 33 that previously had their beak 33*b* close to the axis 3 of the lower needle cylinder 4 are first moved away with their beak 33*b* from the axis 3 of the lower needle cylinder 4, disengaging from the loops of the last row of knitting 80 of the manufacture and then reapproaching with their beak 33*b* the axis 3 of the lower needle cylinder 4. The sinkers 33 that before instead had their beak 33*b* spaced from the axis 3 of the lower needle cylinder 4, are first approached with their beak 33*b* to the axis 3 of the lower needle cylinder 4 and then moved away again.

The movement of the sinkers 33 with their beak 33*b* away from the axis 3 of the lower needle cylinder 4, in the presence of the upward tension applied to the manufacture by the pusher and suction tube 42, obtains the disengagement from the manufacture also of the sinkers 33 that had not yet had the possibility to disengage, bringing all the loops of the last row of knitting 80 into the upper head 9*a* of the needles 8.

Figure 17:
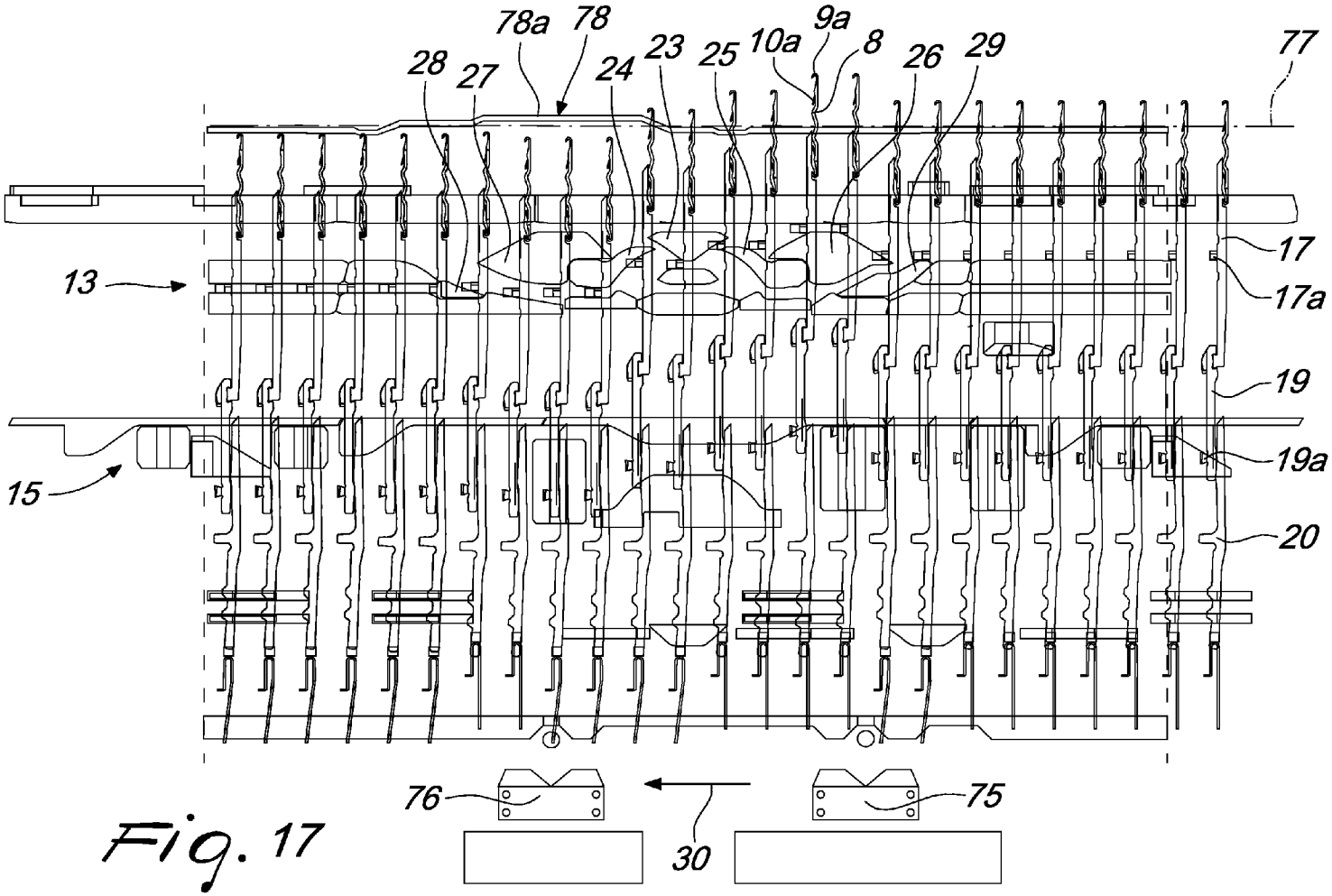
Figure 18:
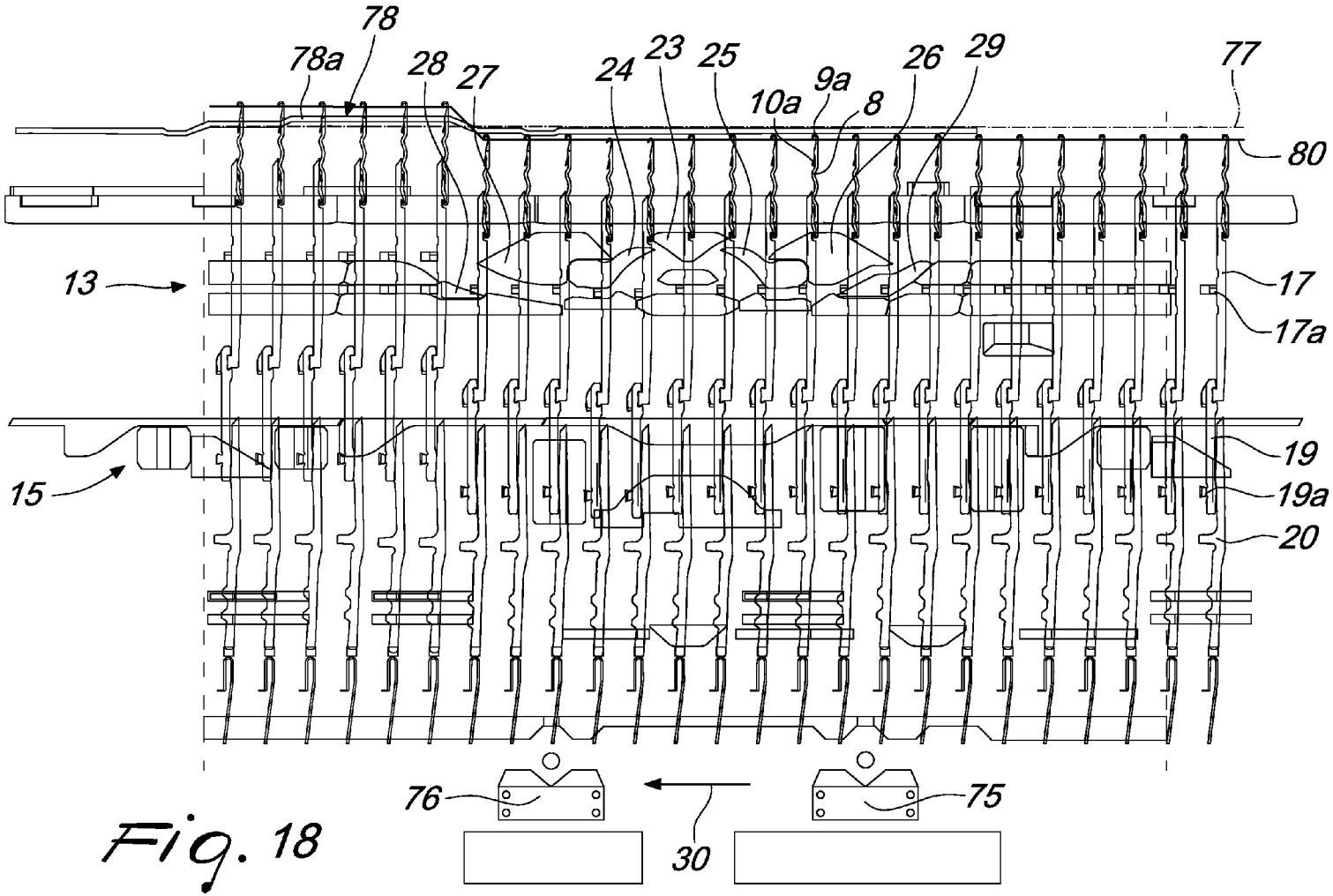
FIG. 18 is a schematic view of a variation of the execution of the fourth step of the method according to the invention, illustrated in a manner similar to FIGS. 5 to 17.

According to a variation of the execution of the fourth step of the method according to the invention, illustrated schematically in FIG. 18 taken similarly to FIGS. 5 to 17, the disengagement of the sinkers 33 from the last formed row of knitting 80 may be obtained also by arranging the portion of the cams 34 for actuating the sinkers 33 that defines the portion 78*a* of the path 78, which causes a movement of the sinkers 33 away from the axis 3 of the lower needle cylinder 4, at the first lifting cam 28. More specifically, instead of imposing a rotation substantially of 360° to the cams 34 for actuating the sinkers 33, a rotation of the cams 34 is performed through an angle of limited breadth so that the portion of the cams 34 for actuating the sinkers 33, which straddles the first knockover cam 24 during the formation of the knitting, is brought at the first lifting cam 28.

In this variation of the execution of the method according to the invention, the second step, the third step and the fourth step of the method, instead of being performed sequentially as described above, are performed substantially simultaneously, or at least the second and fourth steps are performed after the third step. Essentially, the arrangement of the portion 78*a* of the path 78 at the first lifting cam 28, as a consequence of the rotation of the lower needle cylinder 4 about its own axis 3 with respect to the cams 34, causes the disengagement of the sinkers 33 from the manufacture while the needles 8 are lifted into the tuck-stitch position and while the manufacture is pushed upward by the action of the pusher and suction tube 42. In this manner, the loops of the last row of knitting 80 disengage from the sinkers 33 and pass into the upper head 9*a* of the corresponding needle 8. It should be noted that in this variation of the execution of the method the disengagement of the sinkers 33 from the manufacture is performed while the lower needle cylinder 4 rotates about its own axis 3.

In a fifth step of the method, the lifting of the needles in the dropped-stitch position is performed while keeping the manufacture pushed upward, by means of the pusher and suction tube 42, so as to keep the loops of the last formed row of knitting 80 in the upper head 9*a* of the needles 8.

Figure 12:
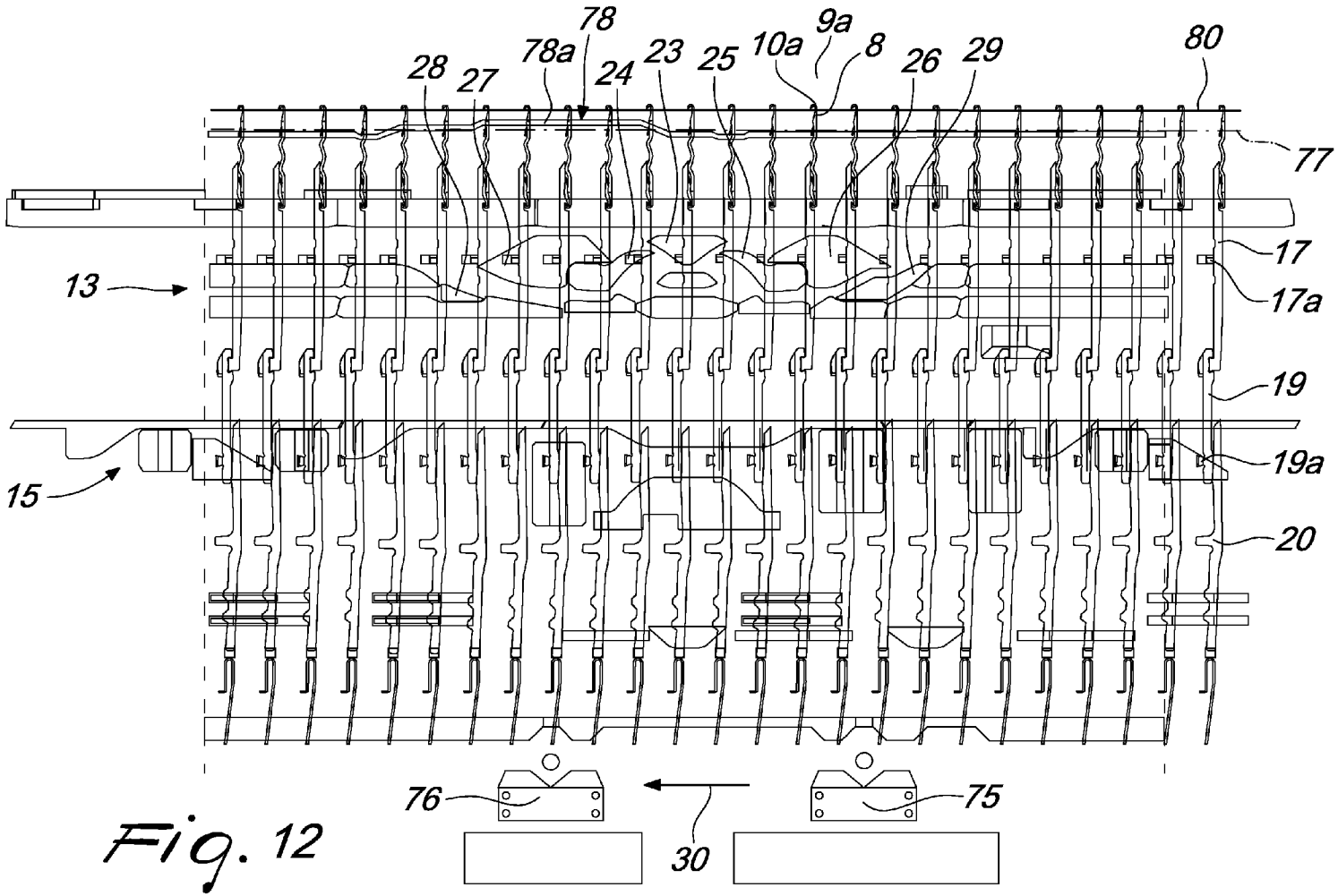
Figure 13:
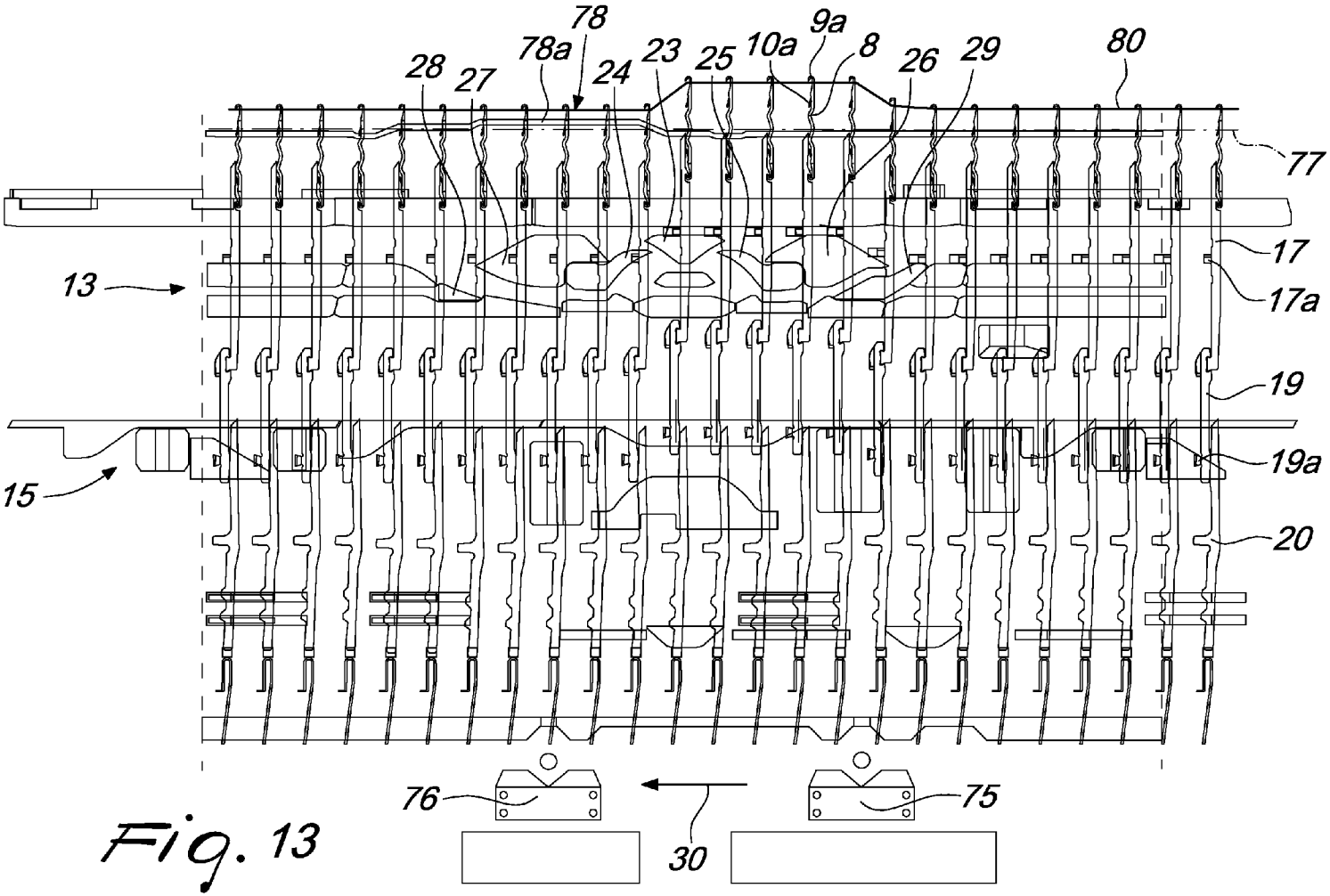

The fifth step is performed by performing the passage of the second lifting cam 29 and of the first dropped-level lifting cam 26 into the first active position, while the sliders 17 provided with a short heel are passing at these cams, so that the cams 29, 26 engage the sliders 17 provided with a long heel without interfering with the sliders 17 provided with a short heel. Subsequently, while the sliders 17 provided with a long heel are passing at the cams 29, 26, the same cams 29, 26 are brought into the second active position so as to engage also the sliders 17 provided with a short heel when they will pass at these cams (FIGS. 12 and 13).

Figure 14:
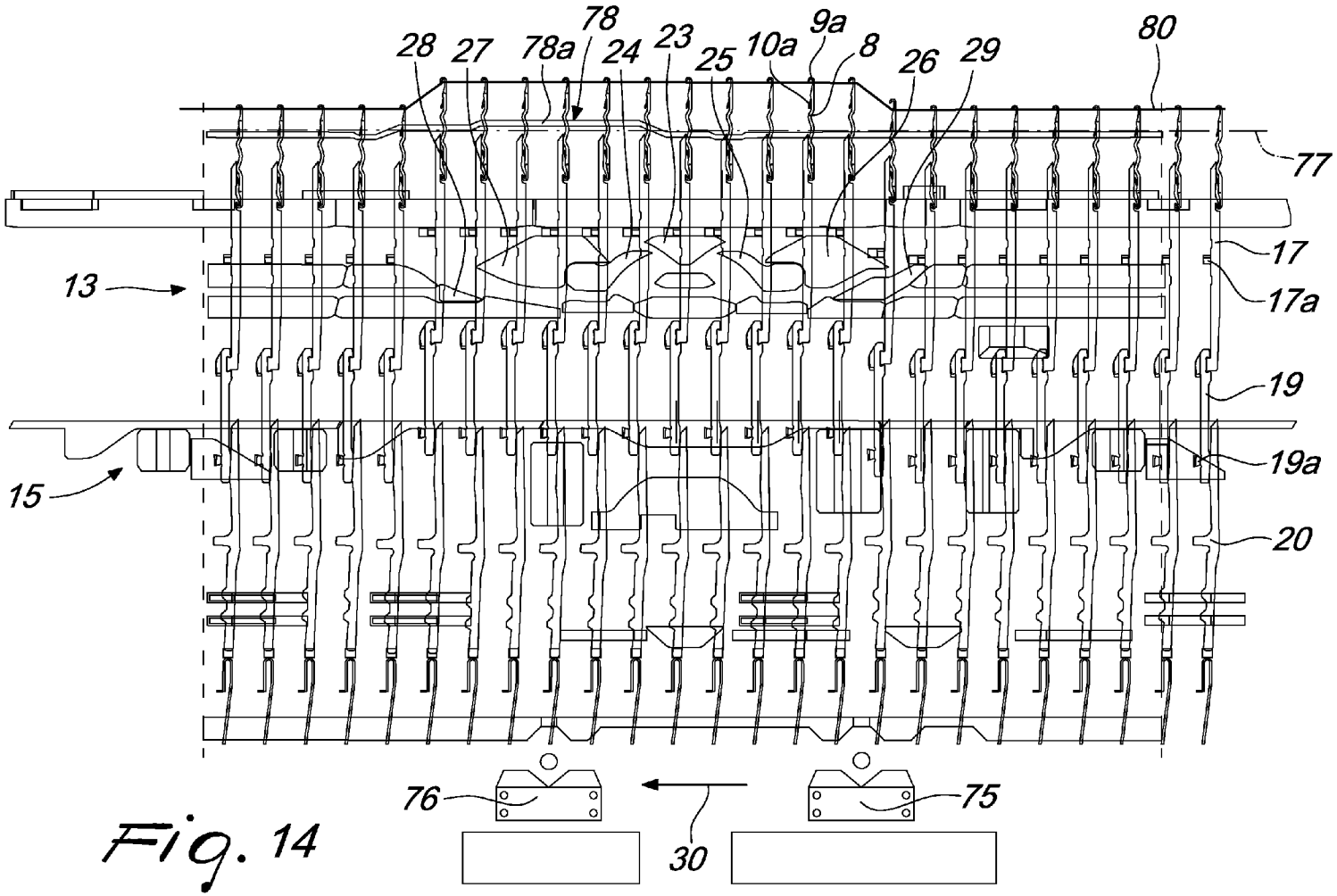

Subsequently, the second knockover cam 25, the central triangle 23, the first knockover cam 24 and the second dropped-level lifting cam 27 are also brought into the second active position (FIG. 14).

Figure 15:
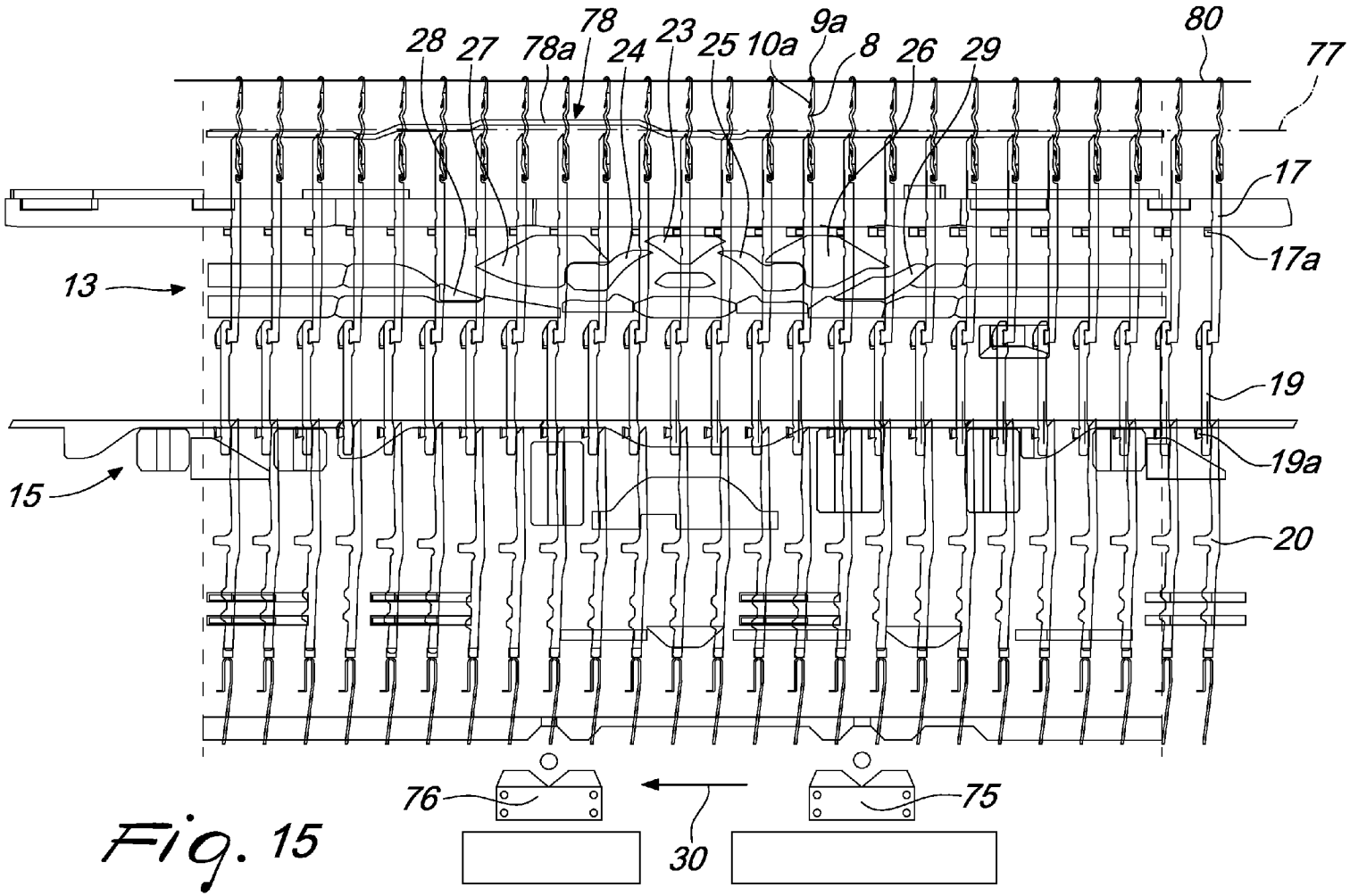

In this manner, all the needles 8 are in the dropped-stitch position and, due to the upward thrust of the manufacture performed by the pusher and suction tube 42, the loops of the last row of knitting 80 are arranged in the upper head 9*a* of the needles 8 (FIG. 15). At this point the rotation of the lower needle cylinder 4 about its own axis 3 is stopped and the manufacture is ready to be picked up from the needles 8 by means of a pick-up device provided with pick-up elements which can engage the stem of the needles 8 below the upper tab 10*a*, for example a pick-up device of the type disclosed in WO2009/112346 and WO2009/112347.

Figure 16:
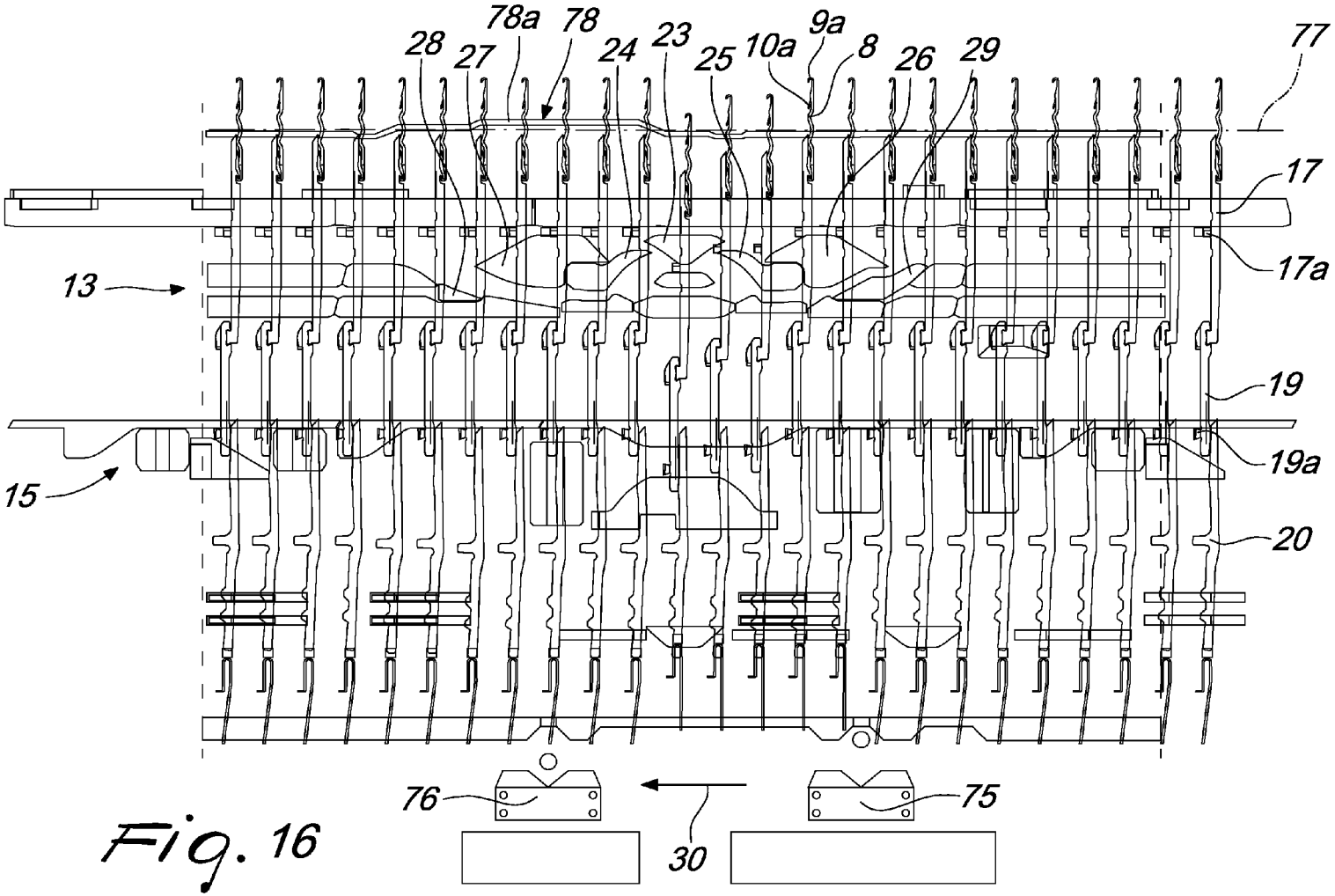

Once the operation for picking up the manufacture has been completed, by means of the actuator arranged at the first selection region 75, the selectors 20 are actuated so as to bring the connecting elements 19 into the active position so that by engaging with their heel 19*a* the cams 15 they cause the lowering of the sliders 17 until the heel 17*a* of the sliders 17 engages the central triangle 23 and then the first knockover cam 24, returning the needles 8 to the floating-stitch position (FIGS. 16 and 17).

In practice it has been found that the method according to the invention and the machine for performing it fully achieve the intended aim, since they make it possible to perform the automated pick-up of the manufacture at the end of its production cycle by means of a pick-up device provided with pick-up elements that can engage the stem of the needles below the upper tab of the needles, particularly a pick-up device of the type disclosed in WO2009/112346 and WO2009/112347.

The method and the machine for performing it thus conceived are susceptible of numerous modifications and variations, all of which are within the scope of the appended claims. All the details may further be replaced with other technically equivalent elements.

In practice, the materials used, as well as the dimensions, may be any according to requirements and to the state of the art.

The disclosures in Italian Patent Application No. MI2011A001683 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A method for preparing a tubular manufacture for automated pick-up at an end of its formation on a double-cylinder circular machine with at least one feed or drop, comprising at least the following steps:

a first stepof transferring or retaining all the needles in a lower needle cylinder with loops of a last formed row of knitting of the manufacture engaged in an upper head of the needles, tensioning the manufacture downward inside a lower needle cylinder;

a second step, of moving all the needles to the tuck-stitch position so that the loops are at an upper tab of each needle;

a third step of pushing upward the portion of the manufacture engaged with the needles;

a fourth step of disengaging sinkers from the manufacture so that said manufacture, due to an upward thrust, moves so that the loops of the last formed row of knitting are in the upper head of the needles;

a fifth step of lifting the needles into a dropped-stitch position, keeping the manufacture pushed upward in order to keep the loops of the last formed row of knitting in the upper head of the needles.

2. The method according to claim 1, wherein after said first step and before said second step it comprises the following intermediate steps:

a first intermediate step of moving all the needles to a floating-stitch position with an upper head below a knockover plane defined by the sinkers; said sinkers being closer with a beak to an axis of the lower needle cylinder except for sinkers located proximate to said at least one feed or drop of the machine;

a second intermediate step of moving an upper needle cylinder away laterally with respect to the lower needle cylinder.

3. The method according to claim 1, wherein said first step, said second step, said third step and said fourth step are performed sequentially.

4. The method according to claim 3, wherein said fourth step is performed with the lower needle cylinder stationary, by turning actuation cams of the sinkers with respect to the lower needle cylinder in order to cause sequentially a spacing of a beak of the sinkers, previously moved closer to the axis of the lower needle cylinder, from the axis of the lower needle cylinder and then a subsequent reapproach of the beak of the sinkers to the axis of the lower needle cylinder.

5. The method according to claim 1, wherein said second step, said third step and said fourth step are performed simultaneously.

6. The method according to claim 1, wherein said third step is performed before said second step and said fourth step, said second step and said fourth step being performed simultaneously.

7. The method according to claim 4, wherein said fourth step is performed by rotating, through an angle of preset breadth, the actuation cams of the sinkers, arranging the part of said actuation cams of the sinkers that provides a spacing of the beak of the sinkers from the axis of the lower needle cylinder at the part of the actuation cams of the needles that provide the transition of the needles from a floating-stitch position to a tuck-stitch position.

8. A double-cylinder circular hosiery knitting machine capable of preparing a tubular manufacture for automated pick-up at an end of its formation on a double-cylinder circular machine with at least one feed or drop, comprising at least the following steps: a first step of transferring or retaining all the needles in a lower needle cylinder with loops of a last formed row of knitting of the manufacture engaged in an upper head of the needles, tensioning the manufacture downward inside a lower needle cylinder; a second step, of moving all the needles to the tuck-stitch position so that the loops are at an upper tab of each needle; a third stepof pushing upward the portion of the manufacture engaged with the needles; a fourth step of disengaging sinkers from the manufacture so that said manufacture, due to an upward thrust, moves so that the loops of the last formed row of knitting are in the upper head of the needles; a fifth step of lifting the needles into a dropped-stitch position, keeping the manufacture pushed upward in order to keep the loops of the last formed row of knitting in the upper head of the needles, the knitting machine comprising a double-cylinder circular hosiery knitting machine comprising a supporting structure which rotatably supports a lower needle cylinder to rotate about an axis, which is oriented vertically, and an upper needle cylinder positionable above and coaxially to the lower needle cylinder; a plurality of axial slots being defined on a lateral surface of said lower needle cylinder and on a lateral surface of said upper needle cylinder; each one of the axial slots of the lower needle cylinder, when said upper needle cylinder is arranged coaxially to said lower needle cylinder, being aligned with an axial slot of the upper needle cylinder and accommodating a needle that can perform a translational motion on command from said lower needle cylinder to said upper needle cylinder or vice versa; each one of the axial slots of said lower needle cylinder accommodating elements for actuating the corresponding needle when it is arranged in said lower needle cylinder, and each one of the axial slots of said upper needle cylinder accommodating elements for actuating a corresponding needle when it is arranged in said upper needle cylinder; around said lower needle cylinder and around said upper needle cylinder cams being provided for the actuation of needles which can engage said actuation elements of the needles arranged in the axial slots of said lower needle cylinder and of said upper needle cylinder; sinkers, each with a beak, being accommodated inside said lower needle cylinder so that each beak lies between two contiguous axial slots and so that they can move with the beak toward and away from the axis of the lower needle cylinder; cams being provided for the actuation of the sinkers which define at least one path that can be followed by a heel of the sinkers as a consequence of rotation of the lower needle cylinder with respect to said cams of the sinkers and is contoured to provide the movement of the sinkers with their beak toward or away from the axis of the lower needle cylinder; wherein said cams of the sinkers are supported so that they can rotate by said supporting structure about the axis of said lower needle cylinder, means being provided for the actuation of said cams for actuating the sinkers and being actuatable to provide a rotation, through an angle of preset breadth, of said cams of the sinkers about the axis of said lower needle cylinder with respect to said lower needle cylinder and said supporting structure.

9. The knitting machine according to claim 8, wherein said cams for actuating the sinkers are connected to a sleeve, which is arranged internally and coaxially to the lower needle cylinder; said sleeve being rotatably supported to rotate about an axis by said lower needle cylinder and protruding from a lower end of said lower needle cylinder; said actuation means comprising an actuator which is associated with said supporting structure and is connected to said sleeve.

10. The knitting machine according to claim 8, wherein a pusher and tensioning tube is arranged internally and coaxially to said lower needle cylinder, can be connected to a suction means and is adapted to receive the manufacture starting from an axial end thereof that lies opposite with respect to the end engaged with the needles; said pusher and tensioning tube being rotatable about the axis of said lower needle cylinder jointly with said lower needle cylinder and being axially movable with respect to said lower needle cylinder to push upward the axial end of said manufacture engaged with said needles.

* * * * *